US010374357B2

(12) United States Patent
Yamada

(10) Patent No.: US 10,374,357 B2
(45) Date of Patent: Aug. 6, 2019

(54) HOUSING AND CONNECTOR

(71) Applicant: J.S.T. Mfg. Co., Ltd., Osaka-shi, Osaka (JP)

(72) Inventor: Hideyasu Yamada, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 34 days.

(21) Appl. No.: 15/840,441

(22) Filed: Dec. 13, 2017

(65) Prior Publication Data

US 2018/0219325 A1 Aug. 2, 2018

(30) Foreign Application Priority Data

Jan. 27, 2017 (JP) ..... 2017-012732

(51) Int. Cl.

| | |
|---|---|
| ***H01R 13/15*** | (2006.01) |
| ***H01R 13/62*** | (2006.01) |
| ***H01R 13/629*** | (2006.01) |
| ***H01R 13/631*** | (2006.01) |
| ***H01R 12/77*** | (2011.01) |
| ***H01R 12/88*** | (2011.01) |
| *H01R 12/79* | (2011.01) |

(52) U.S. Cl.

CPC ..... *H01R 13/62983* (2013.01); *H01R 12/777* (2013.01); *H01R 12/88* (2013.01); *H01R 13/631* (2013.01); *H01R 12/79* (2013.01)

(58) Field of Classification Search

CPC ..... H01R 12/79; H01R 23/688; H01R 12/88; H01R 23/684

USPC ..... 439/495, 260

See application file for complete search history.

(56) References Cited

U.S. PATENT DOCUMENTS

2010/0081312 A1* 4/2010 Kodaira ..... H01R 12/79 439/329
2013/0309887 A1* 11/2013 Honda ..... H01R 13/193 439/260
2014/0342592 A1* 11/2014 Ashibu ..... H01R 12/79 439/267

FOREIGN PATENT DOCUMENTS

JP 2013-109970 A 6/2013

* cited by examiner

*Primary Examiner* — Abdullah A Riyami
*Assistant Examiner* — Thang H Nguyen
(74) *Attorney, Agent, or Firm* — Kratz, Quintos & Hanson, LLP

(57) ABSTRACT

In a connector including: a plurality of contacts each making connection by sandwiching a connecting member; and a housing in which the contacts are to be accommodated, the housing includes a housing body in which the contacts are to be accommodated, and an operating portion that moves the contacts such that the contacts perform sandwiching, and, in a case where the contacts sandwich the connecting member, a portion in which the housing body and the operating portion are connected together is cut off when the operating portion is operated.

12 Claims, 20 Drawing Sheets

HOUSING AND CONNECTOR

BACKGROUND

Technical Field

The present invention relates to a housing and a connector having a structure capable of reducing the number of components, and facilitating assembly, and further, facilitating connection with a printed circuit board.

Related Art

As a connector to be connected with, for example, a flexible print circuit (FPC) as a printed circuit board, a connector for flat signal transmission media is disclosed in JP 2013-109970 A mentioned below, for example. The connector for flat signal transmission media of JP 2013-109970 A mentioned below includes: a contact that mates a signal transmission medium, in which contact terminals are arrayed as a front side terminal and a rear side terminal at respective positions shifted back and forth with respect to an insertion direction alternately; and a housing in which the contacts are alternately arranged, in which one side of each of the contacts is directed toward a mating side to be a first contact, and another side of each of the contacts is directed toward the mating side to be a second contact, and, in each of the contacts, a contact point to be in contact with contact terminals of the signal transmission medium is provided at a position to be in contact with the rear side terminal, in the one side, and is provided at a position to be in contact with the front side terminal, in the other side.

SUMMARY

Incidentally, the connector for flat signal transmission media disclosed in JP 2013-109970 A includes a contact, a housing, and an actuator (paragraph [0022]), and the housing and the actuator are configured to be separately manufactured and then assembled. For that reason, there is a problem that the number of components increases, and the number of assembly processes increases.

The present invention has been made to solve the problems of a conventional technology as described above, and an object of the present invention is to provide a housing and a connector having a structure capable of reducing the number of components, and facilitating assembly, and further, facilitating connection with a printed circuit board.

To achieve the above object, a housing according to a first aspect of the present invention is a housing to which a plurality of contacts each making connection by sandwiching a connecting member is mounted, the housing including:

a housing body in which the contacts are to be accommodated; and an operating portion that moves the contacts accommodated in the housing body such that the contacts sandwich the connecting member, in which, in a case where the contacts sandwich the connecting member, a portion in which the housing body and the operating portion are connected together is cut off when the operating portion is operated.

A housing of a second aspect, in the housing of the first aspect, is a housing to which a plurality of contacts each making connection by sandwiching a connecting member is mounted, the housing including:

a housing body in which the contacts are to be accommodated; and an operating portion that moves the contacts accommodated in the housing body such that the contacts sandwich the connecting member, in which, during mounting of the contacts, a portion in which the housing body and the operating portion are connected together is cut off when the operating portion is pressed.

A housing of a third aspect is the housing of the first or the second aspect, in which the housing body includes an opening portion into which the connecting member is inserted, a side of the opening portion of the housing body includes a contact insertion slot into which each of the contacts is inserted, and the operating portion is provided in an opposite side to the contact insertion slot of the housing body.

A connector of a fourth aspect is a connector including: a plurality of contacts each making connection by sandwiching a connecting member; and a housing in which the contacts are to be accommodated, in which the housing includes a housing body in which the contacts are to be accommodated, and an operating portion that moves the contacts such that the contacts perform sandwiching, and, in a case where the contacts sandwich the connecting member, a portion in which the housing body and the operating portion are connected together is cut off when the operating portion is operated.

A connector of a fifth aspect is a connector including: a plurality of contacts each making connection by sandwiching a connecting member; and a housing in which the contacts are to be accommodated, in which the housing includes a housing body in which the contacts are to be accommodated, and an operating portion that moves the contacts such that the contacts perform sandwiching, and, during mounting of the contacts, a portion in which the housing body and the operating portion are connected together is cut off when the operating portion is pressed.

A connector of a sixth aspect is the connector of the fourth or the fifth aspect, in which the housing body includes an opening portion into which the connecting member is inserted, a side of the opening portion of the housing body includes a contact insertion slot into which each of the contacts is inserted, and the operating portion is provided in an opposite side to the contact insertion slot of the housing body.

A connector of a seventh aspect is a connector of any of the fourth to sixth aspects, in which the contacts each include: an operating piece to be pressed by a pressing portion formed in the operating portion in a side arranged in an opposite side to the contact insertion slot; and an arm portion having a contact portion to be brought into contact with the connecting member, in an opposite side to the operating piece, and when the operating portion is operated, the operating piece is pressed by the pressing portion moved, and the arm portion sandwiches the connecting member.

A connector of an eighth aspect is a connector of any of the fourth to seventh aspects, in which the contacts include a first contact and a second contact that respectively have different shapes from each other, the first contact has a first mounting portion to be mounted to a mounting member, the first mounting portion being formed in a side of the opening portion of the housing body, the second contact has a second mounting portion to be mounted to the mounting member, the second mounting portion being formed in an opposite side to the opening portion of the housing body, and in a side of the mounting member of the housing body, an insertion groove through which the second mounting portion of the second contact is inserted is formed apiece along an insertion direction of the second contact.

According to the housing of the first aspect, the housing body and the operating portion are integrally formed, whereby the number of components can be reduced. In addition, cutting off between the housing body and the operating portion can be performed in a case where the connecting member and the contacts are connected together.

According to the housing of the second aspect, the housing body and the operating portion are integrally formed, whereby the number of components can be reduced. In addition, cutting off between the housing body and the operating portion can be performed in a case where the contacts are mounted to the housing.

According to the housing of the third aspect, the plurality of contacts can be collectively inserted from the opposite side to the side in which the operating portion is provided, so that assembly can be easily performed.

According to the connector of the fourth aspect, the housing body and the operating portion are integrally formed, whereby the number of components can be reduced. In addition, cutting off between the housing body and the operating portion can be performed in a case where the connecting member and the contacts are connected together.

According to the connector of the fifth aspect, the housing body and the operating portion are integrally formed, whereby the number of components can be reduced. In addition, cutting off between the housing body and the operating portion can be performed in a case where the contacts are mounted to the housing.

According to the connector of the sixth aspect, the plurality of contacts can be collectively inserted from the opposite side to the side in which the operating portion is provided, so that assembly can be easily performed.

According to the connector of the seventh aspect, even when the operating piece and the housing body are integrally formed, the contacts can be inserted from the side of the opening portion of the housing.

According to the connector of the eighth aspect, the first contact and the second contact are provided that respectively have different positions in which the mounting portion to be mounted to the mounting member is formed, whereby a pitch between the contacts can be narrowed. In addition, each of the first contact and the second contact can be inserted from the side that is the opposite side to the operating portion and in which the opening portion of the housing is formed.

DETAILED DESCRIPTION

Figure 1A:
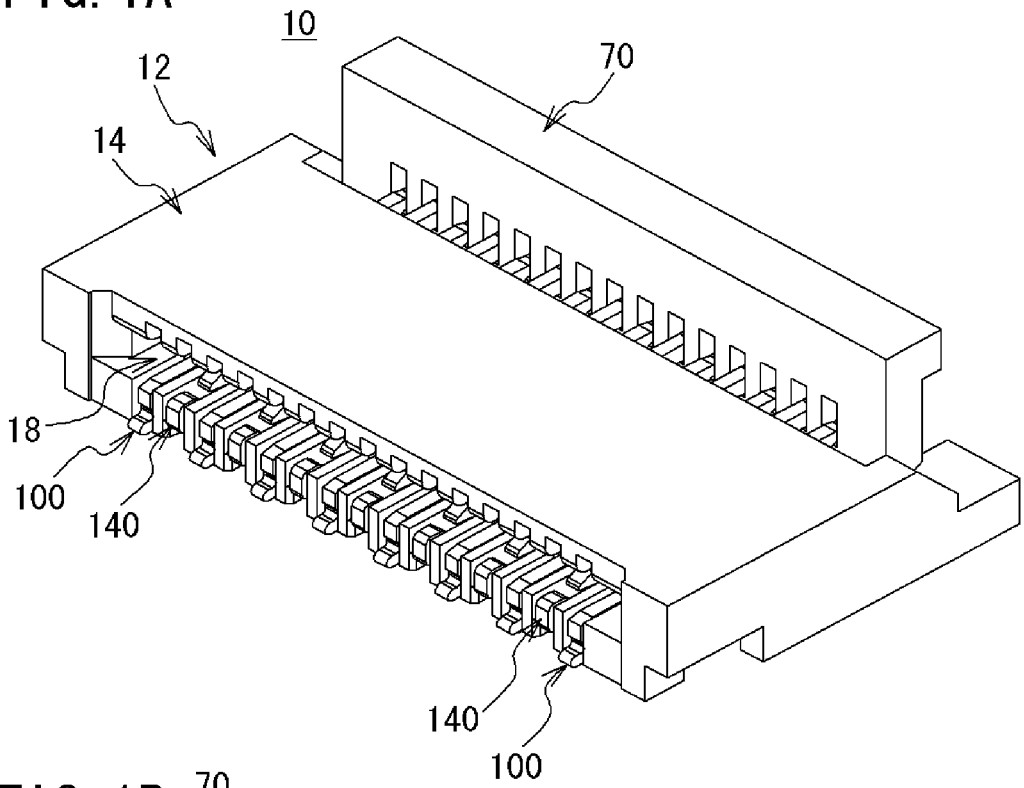
FIG. 1A is a perspective view from one side of a connector of an embodiment.
Figure 1B:
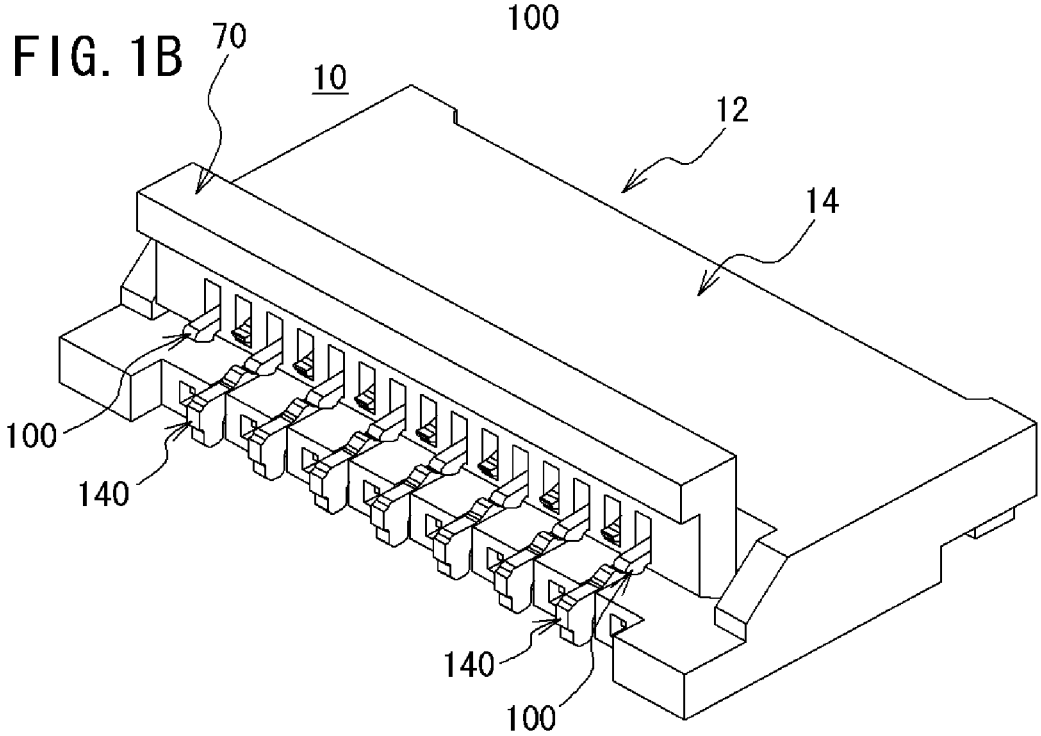
FIG. 1B is a perspective view from another side.
Figure 2:
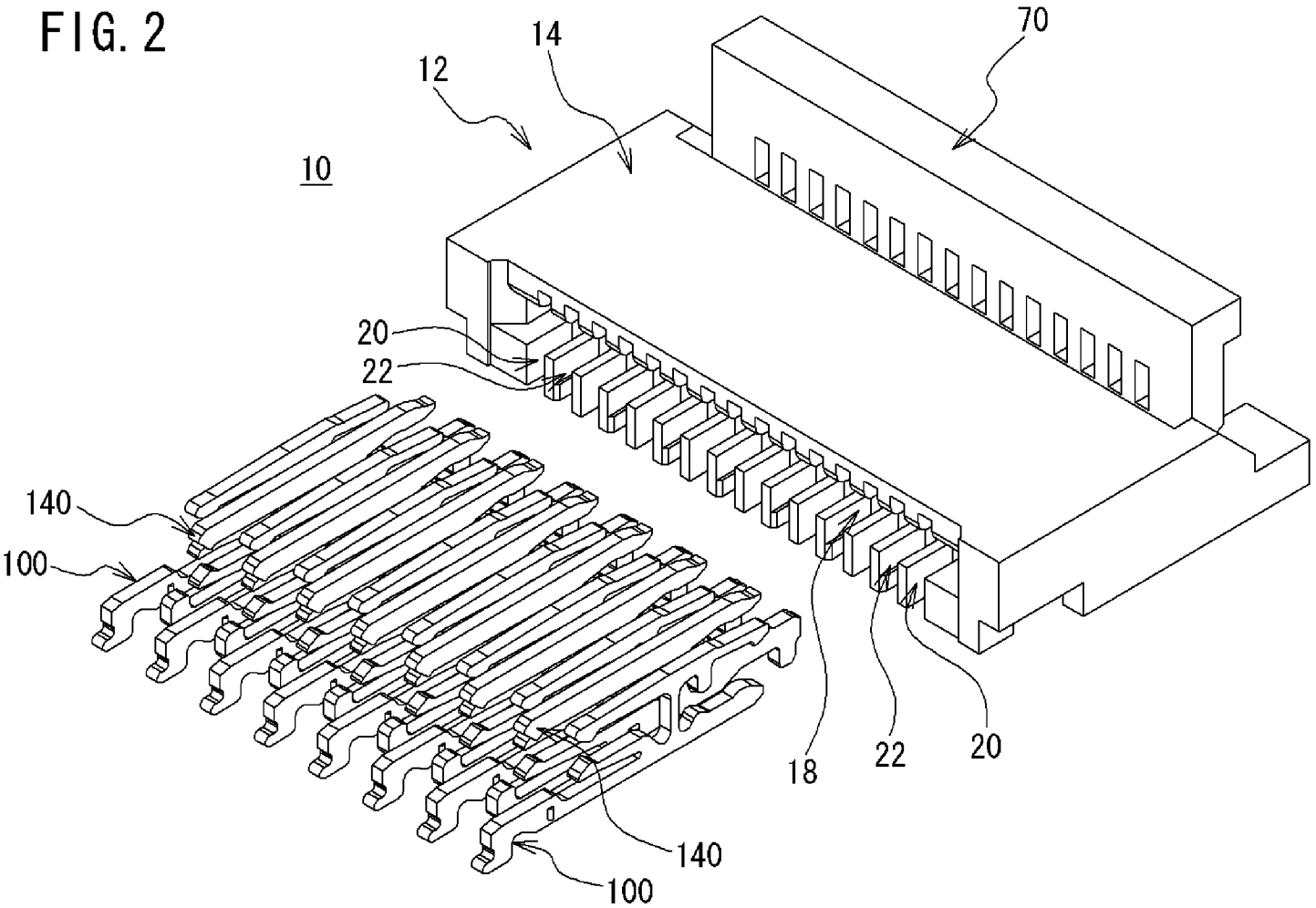
FIG. 2 is an exploded perspective view from one side of the connector of the embodiment.
Figure 3A:
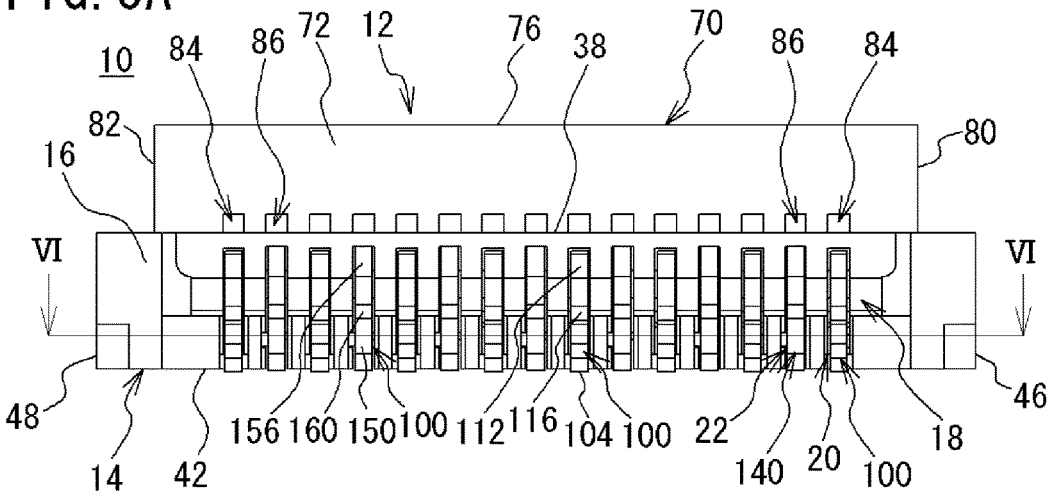
FIG. 3A is a front view of the connector of the embodiment.
Figure 3B:
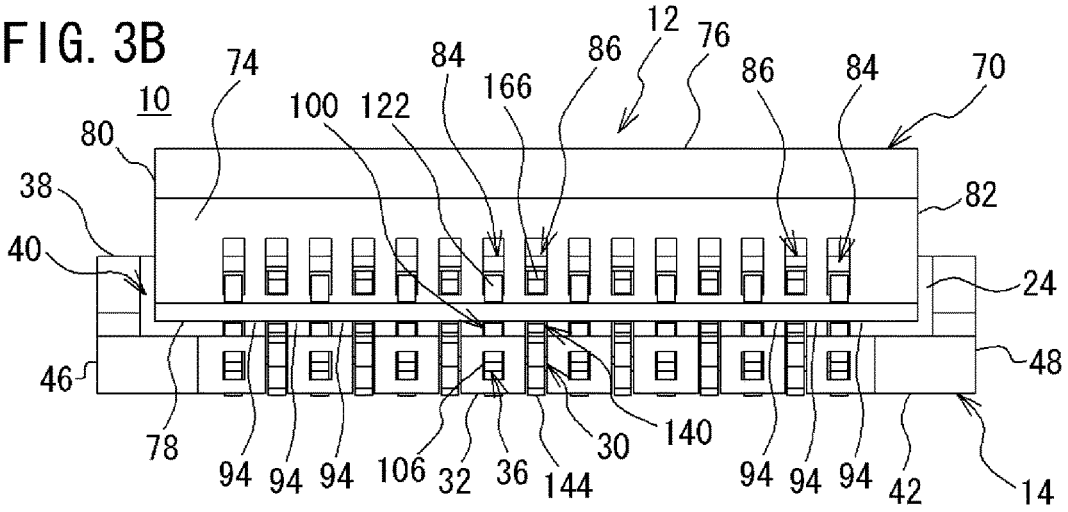
FIG. 3B is a rear view.
Figure 3C:
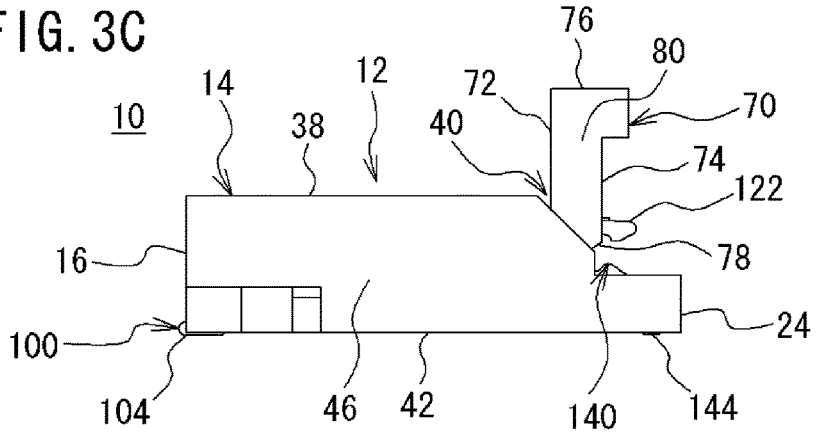
FIG. 3C is a side view from one side.
Figure 4A:
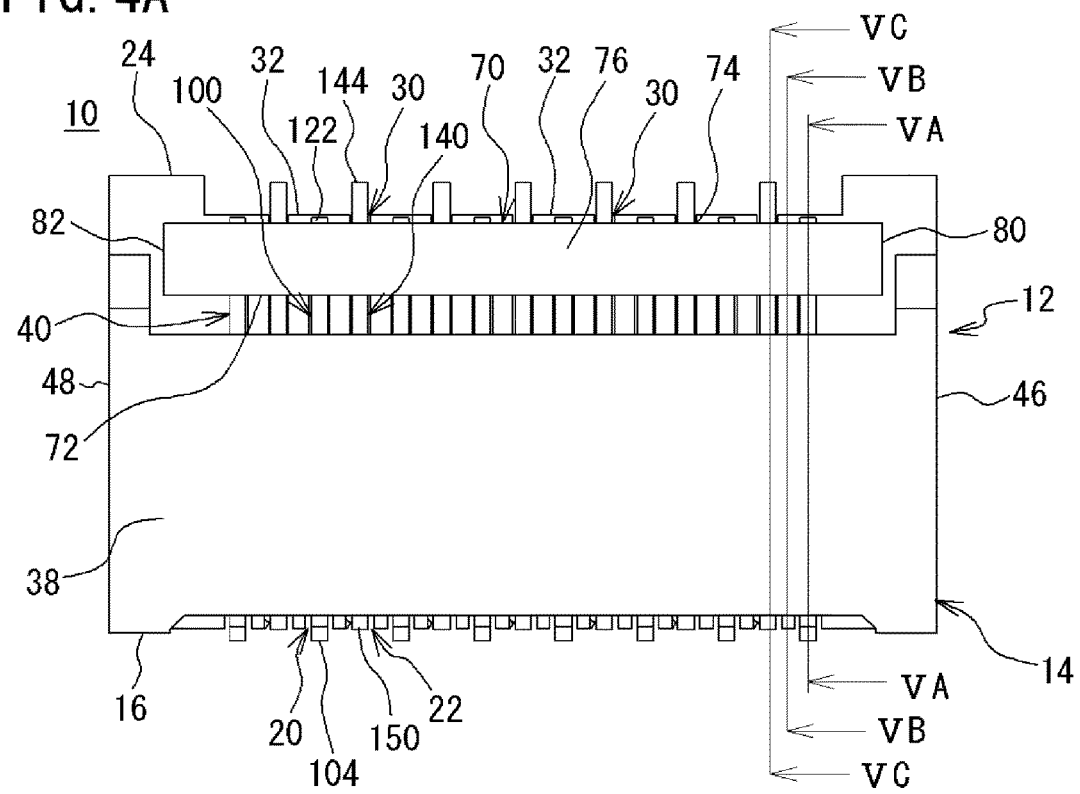
FIG. 4A is a plan view of the connector.
Figure 4B:
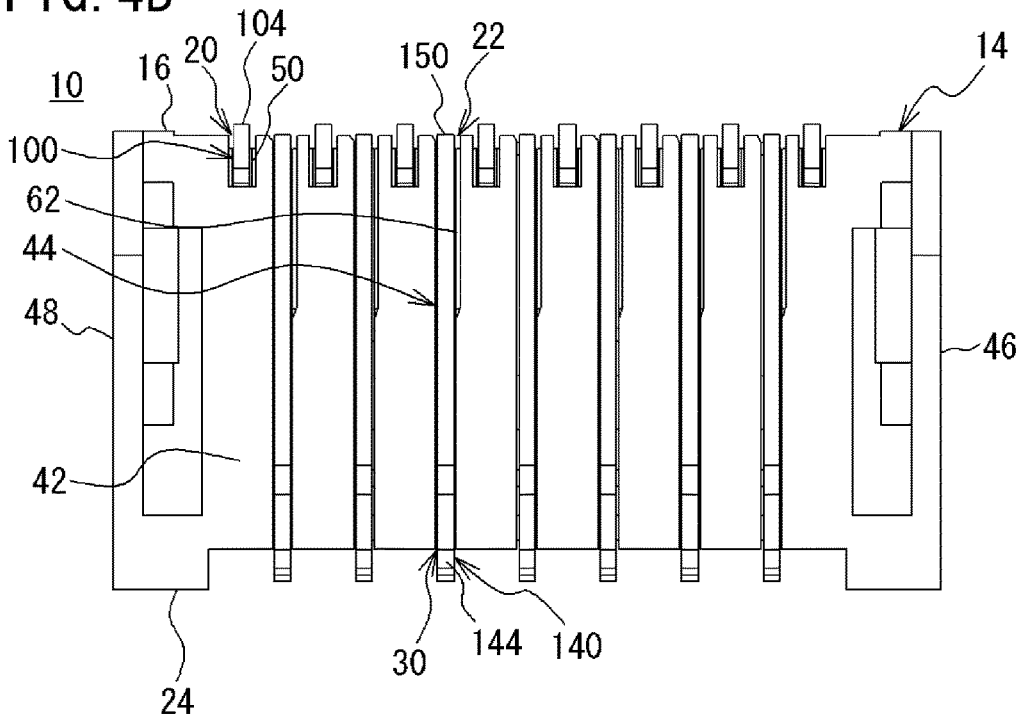
FIG. 4B is a bottom view.

Hereinafter, an embodiment of the present invention will be described with reference to the drawings. However, the embodiment described below exemplifies a housing and a connector for embodying a technical idea of the present invention, and the present invention is not intended to be specified to the housing and the connector, and can be equally applied to other embodiments included in the claims.

EMBODIMENT

A connector 10 according to the embodiment will be described with reference to FIGS. 1A and 1B to FIGS. 20A and 20B. The connector 10 of the embodiment, as illustrated in FIGS. 1A and 1B to FIG. 6, includes a plurality of contacts 100 and 140, and a housing 12 in which these contacts 100 and 140 are to be accommodated, and is mounted on a circuit board or the like as a mounting member (not illustrated), and then a printed circuit board such as an FPC (hereinafter, simply referred to as an FPC 200.) as a connecting member inserted into the connector and the contacts are connected together. At this time, the connector 10 of the embodiment is configured such that the contacts 100 and 140 can be moved to sandwich the FPC 200 by operating an operating portion 70 provided to the housing 12 (see FIGS. 18A to 18C, FIGS. 19A to 19C).

The housing 12 constituting the connector 10 of the embodiment includes a flat opening portion 18 into which the FPC 200 is inserted is formed at one side, and a housing body 14 in which the plurality of contacts 100 and 140 are to be accommodated, and the operating portion 70 for operating the plurality of contacts 100 and 140 accommodated in the opposite side to the opening portion 18 of the housing body 14 are integrated together. In a case where the FPC 200 inserted is sandwiched by the plurality of contacts 100 and 140, an operator operates the operating portion 70, and a portion in which the housing body 14 and the operating portion 70 are connected together is cut off, whereby the operating portion 70 can be moved.

The plurality of contacts provided to the connector 10 of the embodiment is provided such that two types of contacts respectively formed in different shapes, first contacts 100 and second contacts 140, are alternately arranged.

Incidentally, the printed circuit board is not limited to the FPC, and a flexible flat cable (FFC) or the like can be used.

Hereinafter, structures of the connector 10 of the embodiment will be described.

First, mainly, with reference to FIGS. 5A to 5C to FIGS. 8A to 8C, the first contacts 100 and the second contacts 140 provided to the connector 10 of the embodiment will be described. Incidentally, the first contacts 100 each have a common structure, so that one first contact 100 will be described as a representative, and for the second contacts 140, similarly, one second contact 140 will be described as a representative.

The first contact 100, as illustrated in FIGS. 7A and 7B, and FIGS. 8A to 8C, is formed by, for example, performing punching to a metal plate having a predetermined thickness, and includes a first body portion 102. In the front end side of the first body portion 102, that is, the side to be inserted first into the housing body 14 described later, a fixing piece 106 is formed, and in the rear end side of the first body portion 102 that is the opposite side to the fixing piece 106, a first mounting portion 104 is formed to be mounted to the circuit board.

The fixing piece 106 is inserted into a fixing piece insertion hole 34 inside a fixing portion 32 formed in a rear surface 24 side of a first contact accommodation portion 56 of the housing body 14 described later, and is a portion to be fixed. Incidentally, in the fixing piece 106, at least one protrusion portion is formed, and in the first contact 100 of the embodiment, two fixing protrusion portions 108 to be press-fitted into the fixing piece insertion hole 34 of the housing body 14 are each formed.

Figure 5A:
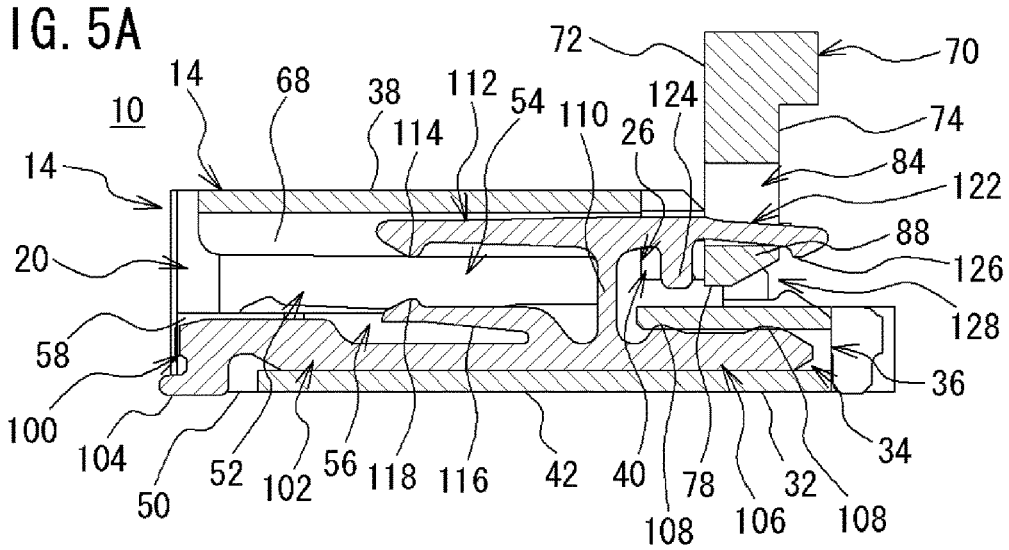
FIG. 5A is a sectional view along a line VA-VA of FIG. 4A.

The first mounting portion 104 of the first body portion 102 is formed to protrude from a bottom surface 42 of the housing body 14 to the circuit board side in a case where the first contact 100 is mounted to the housing body 14 (see FIG. 5A).

In a first surface side 130 that is one side of the first mounting portion 104 side of the first body portion 102, a first press fitting portion 134 is formed to protrude. The first press fitting portion 134 is a portion to be press-fitted when being inserted into the first contact accommodation portion of the housing body 14 (see FIG. 6). Incidentally, in the first contact 100 of the embodiment, the first press fitting portion 134 is formed in the first surface side 130 that is the one side; however, the first press fitting portion 134 may be formed in a first surface side 132 that is another side, or may be formed in the both surface sides 130 and 132.

In the first body portion 102, a first columnar portion 110 is formed extended upward, that is, toward the opposite direction to the side to which the first mounting portion 104 protrudes. Incidentally, in the embodiment, the first columnar portion 110 is formed perpendicular to the first body portion 102, and is extended from between the fixing piece 106 and a substantially central portion of the first body portion 102, for example.

From the end portion of the opposite side to the first body portion 102 of the first columnar portion 110, a first arm portion 112 extended along the first body portion 102 is formed toward the first mounting portion 104 side. Incidentally, in the front end side of the first arm portion 112, an upper first contact portion 114 to be brought into contact with a conductor portion (not illustrated) of the FPC 200 inserted is formed to protrude in a convex way to the first body portion 102 side.

Between the first body portion 102 and the first arm portion 112, a first intermediate arm portion 116 is formed extended along the first arm portion 112. In the embodiment, the first intermediate arm portion 116 is extended from near a portion in which the first columnar portion 110 of the first body portion 102 is formed. In addition, the first intermediate arm portion 116 is formed to be slightly inclined toward the first arm portion 112. Further, in the end portion of the first intermediate arm portion 116, a lower first contact portion 118 is formed protruding in a convex way to the first arm portion 112 side. Incidentally, in the embodiment, the upper first contact portion 114 formed in the first arm portion 112 and the lower first contact portion 118 formed in the first intermediate arm portion 116 may be collectively referred to as the first contact portions 114 and 118.

Meanwhile, in the opposite side to the first arm portion 112 of the end portion of the first columnar portion 110, a first operating piece 122 is formed extended along the fixing piece 106. In the end portion of the first operating piece 122, a first protrusion portion 126 is formed protruding to the fixing piece 106 side, and in the first columnar portion 110 side of the first operating piece 122, a first regulating protrusion portion 124 longer than the first protrusion portion 126 is formed extended toward the fixing piece 106 side. Incidentally, a space between the first regulating protrusion portion 124 and the first protrusion portion 126 of the first operating piece 122 is a first pressing portion arrangement portion 128 in which a first pressing portion 88 formed in the operating portion 70 of the housing 12 described later is arranged (see FIG. 5A).

Figure 18A:
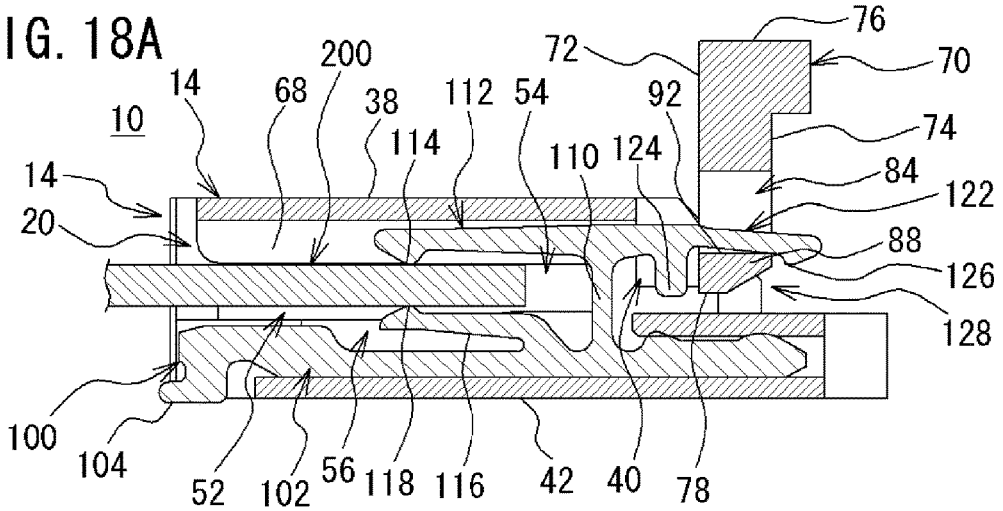
FIGS. 18A to 18C are sectional views respectively corresponding to FIGS. 5A to 5C illustrating a process of connecting an FPC to the housing.
Figure 19A:
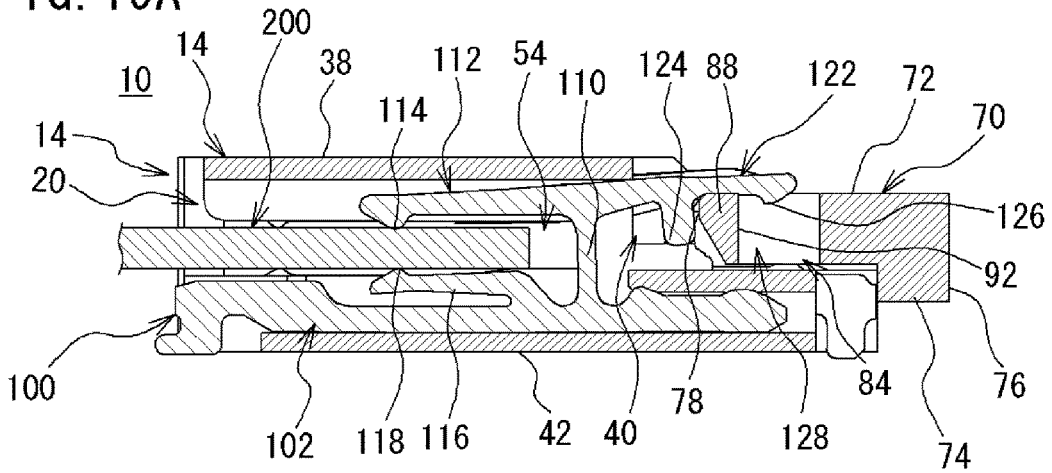
FIGS. 19A to 19C are sectional views illustrating the process of connecting the FPC to the housing respectively subsequent to FIGS. 18A to 18C.

In the first contact 100, when the first operating piece 122 is pressed by the first pressing portion 88 formed in the operating portion 70 of the housing 12 in the direction opposite to the fixing piece 106, the first arm portion 112 is moved to the first intermediate arm portion 116 side with the first columnar portion 110 as a pivot, and the FPC 200 is sandwiched between the upper first contact portion 114 of the first arm portion 112 and the lower first contact portion 118 of the first intermediate arm portion 116 (see FIG. 18A, FIG. 19A). Incidentally, details will be described later.

Next, the second contact 140 will be described mainly with reference to FIGS. 5A to 5C, FIG. 6, FIGS. 9A and 9B, and FIGS. 10A to 10C. The second contact 140, as illustrated in FIGS. 9 and 9B, and FIGS. 10A to 10C, is formed by, for example, performing punching to a metal plate having a predetermined thickness, and includes a second body portion 142. In the front end side of the second body portion 142, that is, the side to be inserted first into the housing body 14, a second mounting portion 144 to be mounted to the circuit board is formed, and in the rear end side of the second body portion 142 that is the opposite side to the second mounting portion, a supporting portion 150 is formed to be supported in a second contact accommodation portion 60 of the housing body 14.

Figure 5B:
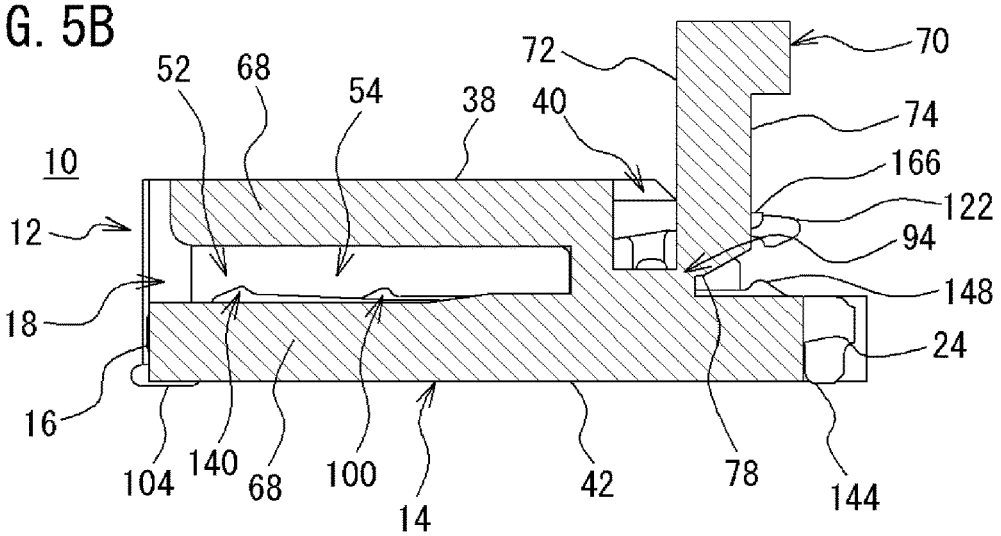
FIG. 5B is a sectional view along a line VB-VB of FIG. 4A.
Figure 5C:
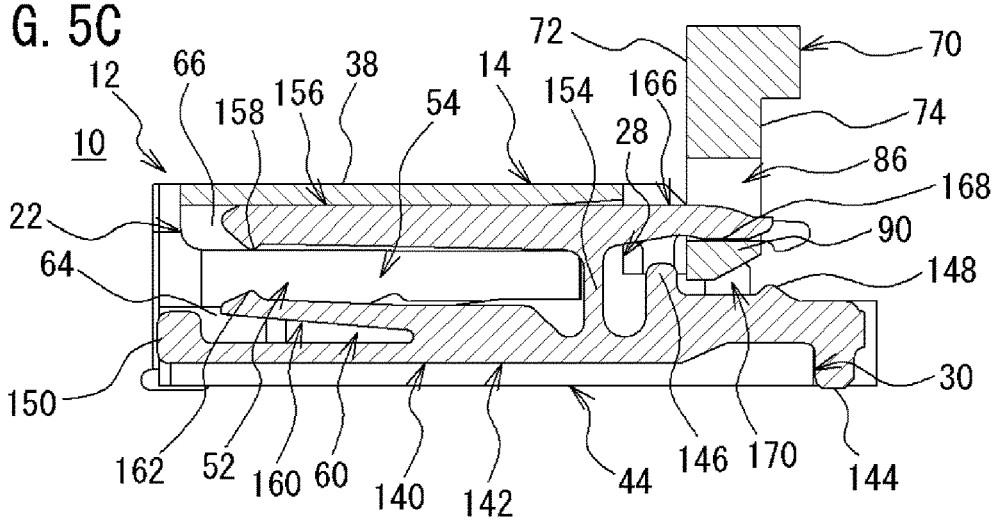
FIG. 5C is a sectional view along a line VC-VC of FIG. 4A.

The second mounting portion 144 of the second body portion 142 is formed to protrude from the bottom surface 42 of the housing body 14 to the circuit board side in a case where the second contact 140 is mounted to the housing body 14 (see FIG. 5C).

In a second surface side 172 that is one side of the second body portion 142, a second press fitting portion 176 is formed to protrude. The second press fitting portion 176 is press-fitted when being inserted into the second contact accommodation portion 60 of the housing body 14.

Figure 6:
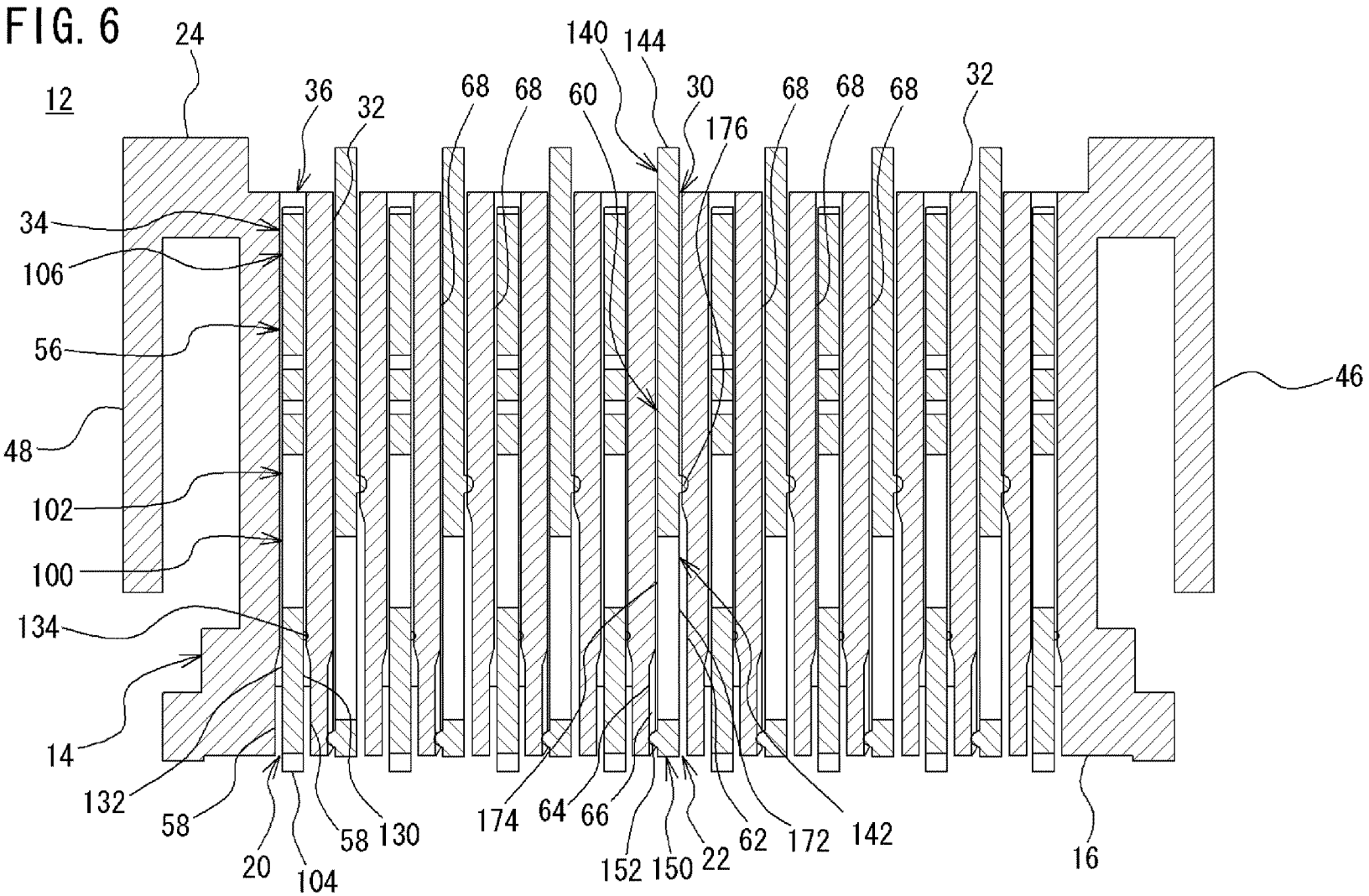
FIG. 6 is a sectional view along a line VI-VI of FIG. 3A.
Figure 7A:
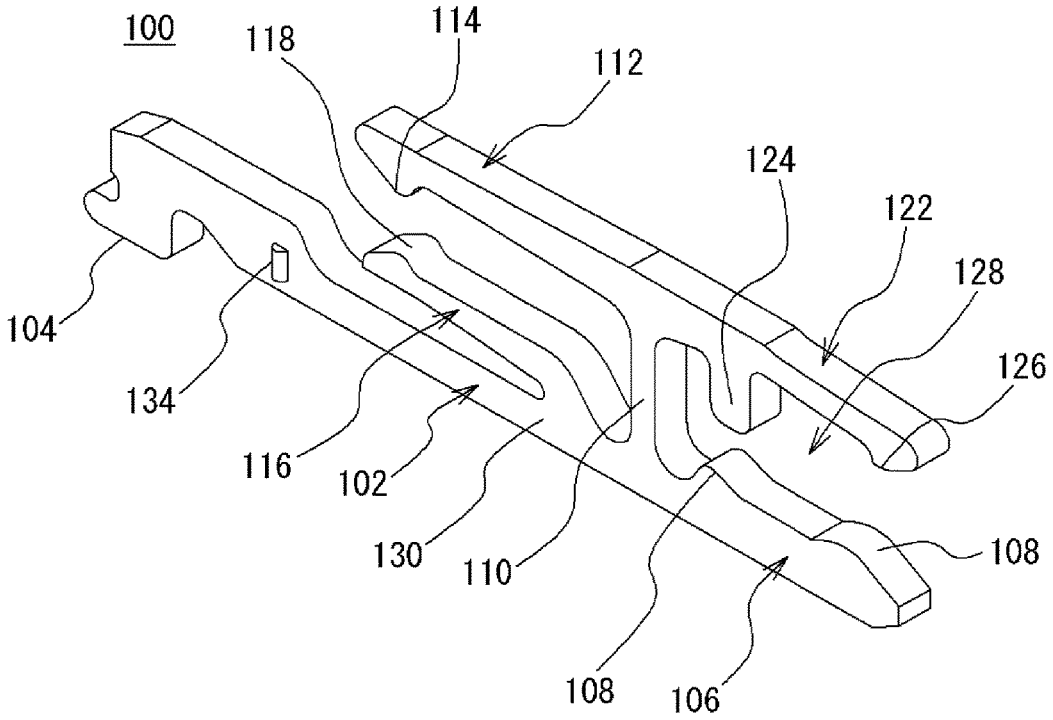
FIG. 7A is a perspective view from one side of a first contact.
Figure 7B:
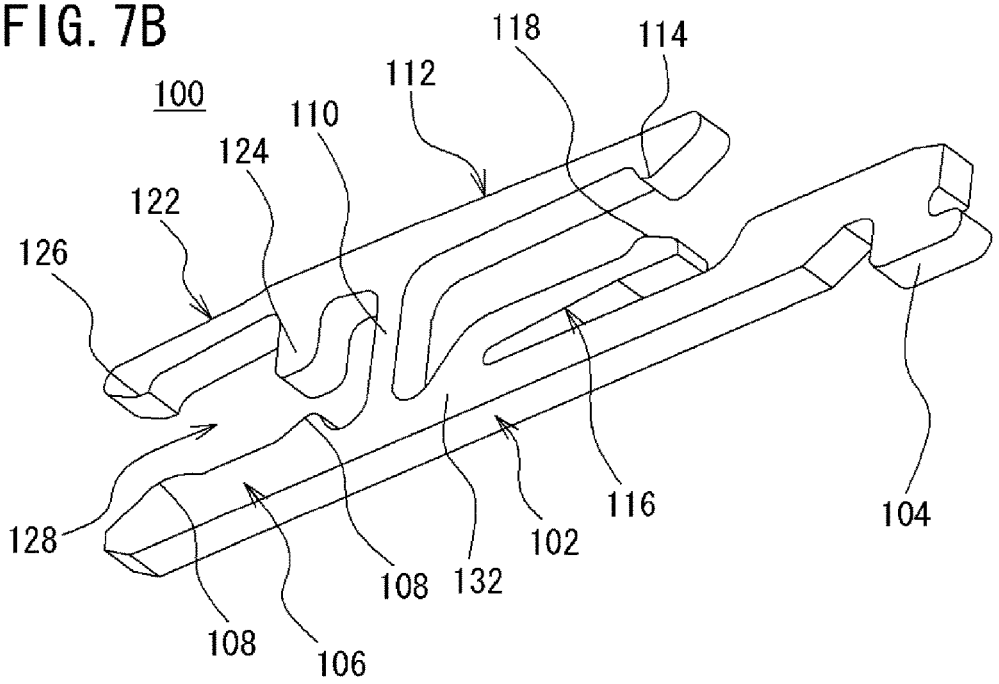
FIG. 7B is a perspective view from another side.
Figure 8A:
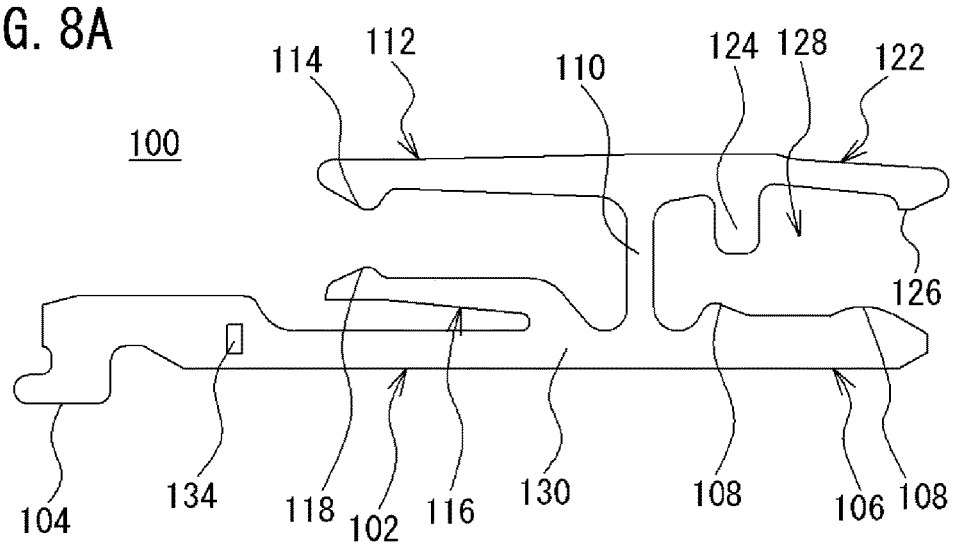
FIG. 8A is a view from one side of the first contact.
Figure 8B:
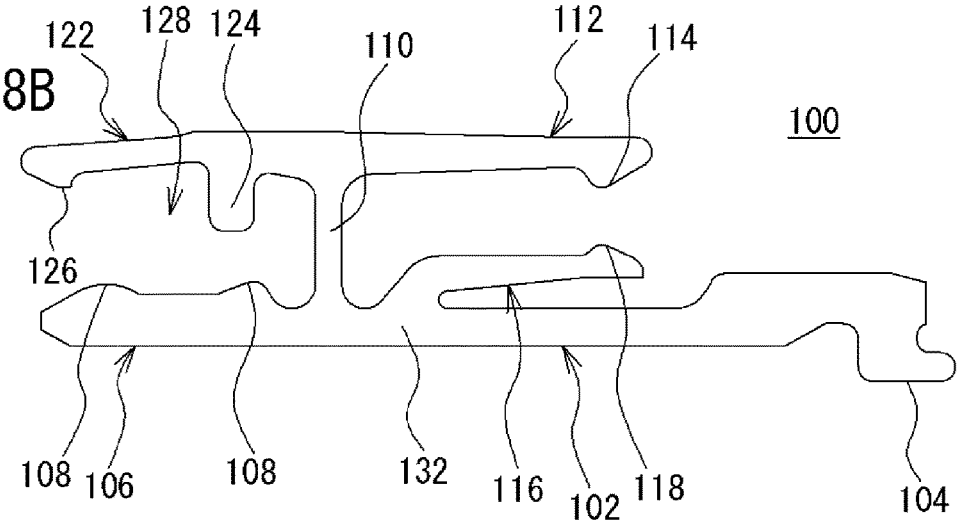
FIG. 8B is a view from another side.
Figure 8C:
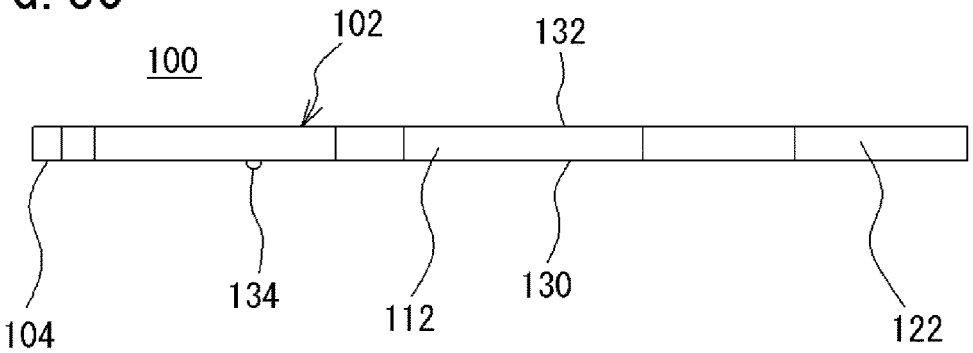
FIG. 8C is a plan view.
Figure 9A:
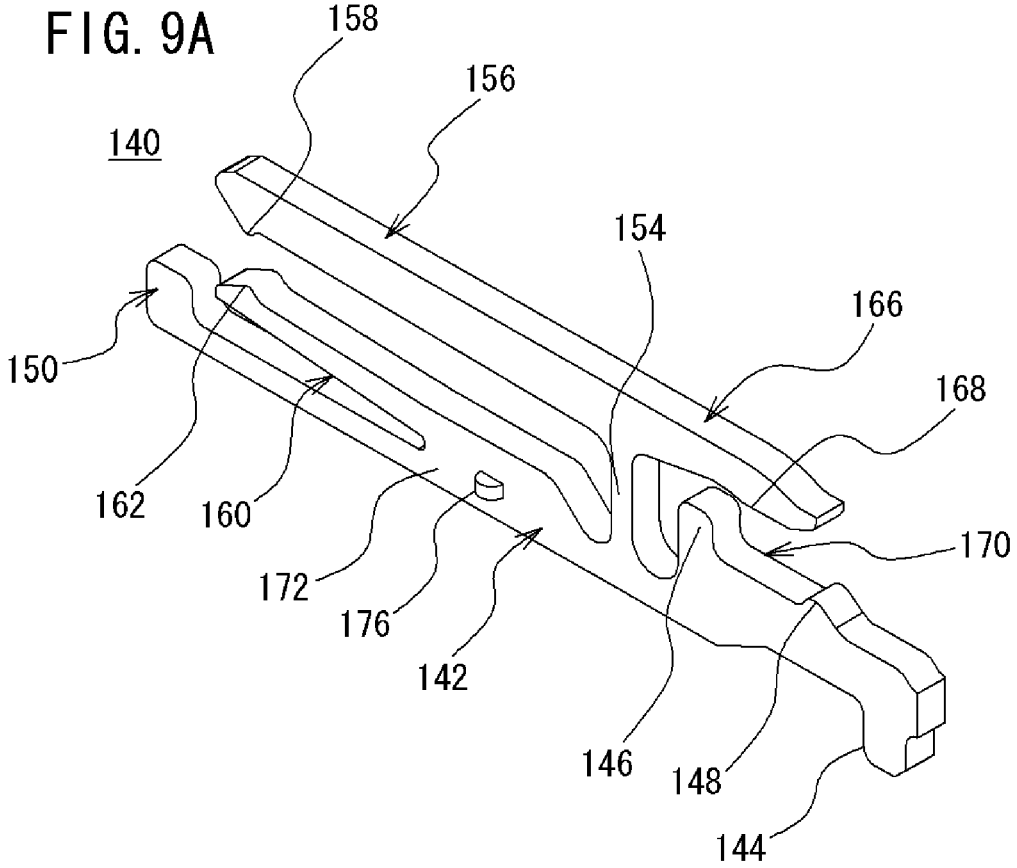
FIG. 9A is a perspective view from one side of a second contact.
Figure 9B:
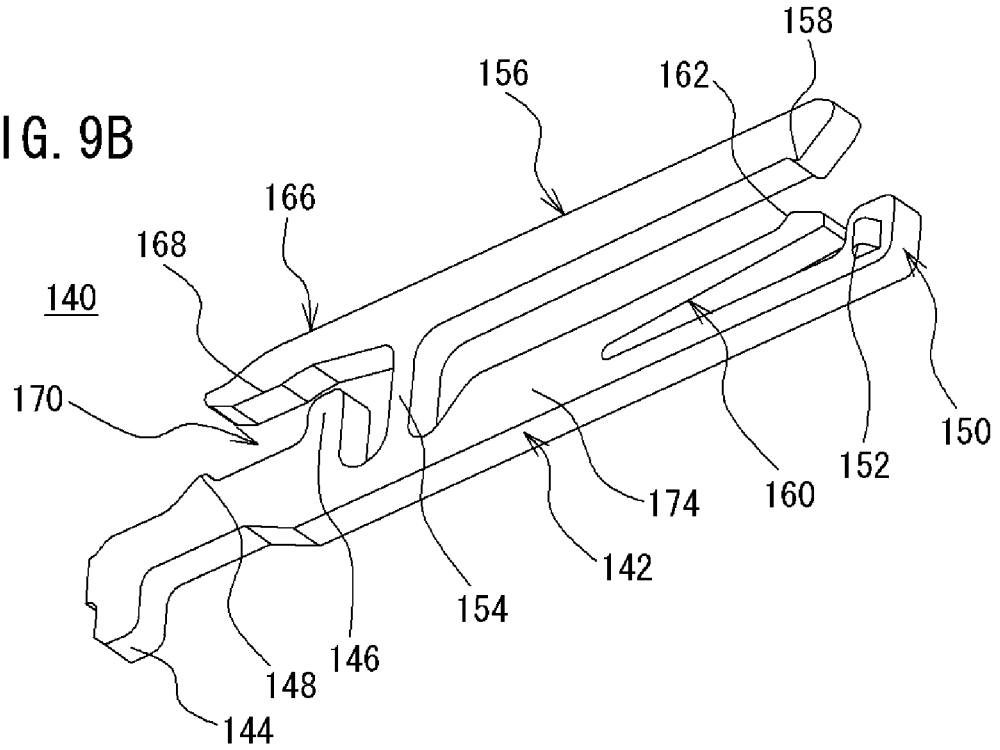
FIG. 9B is a perspective view from another side.
Figure 10A:
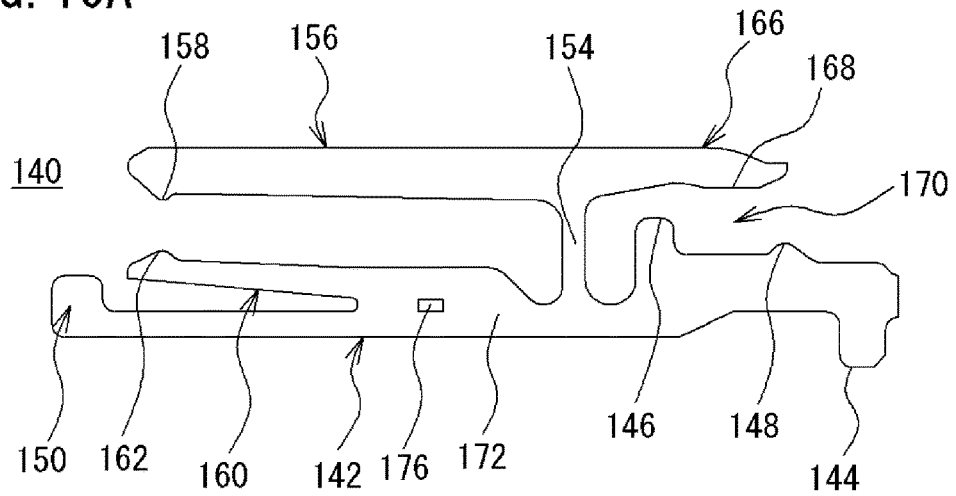
FIG. 10A is a view from one side of the second contact.
Figure 10B:
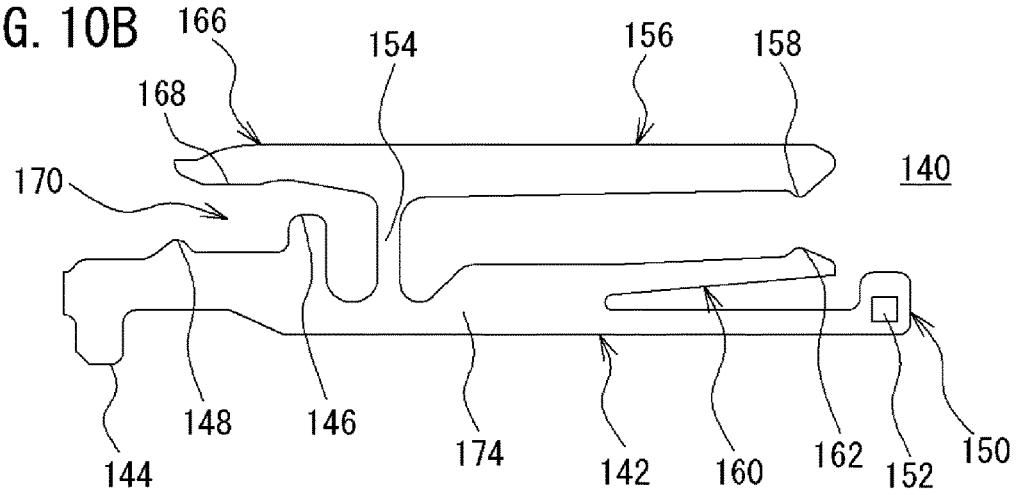
FIG. 10B is a view form another side.
Figure 10C:
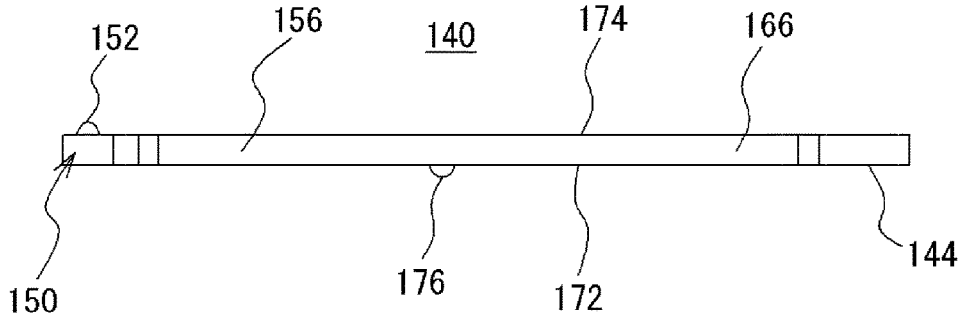
FIG. 10C is a plan view.
Figure 11A:
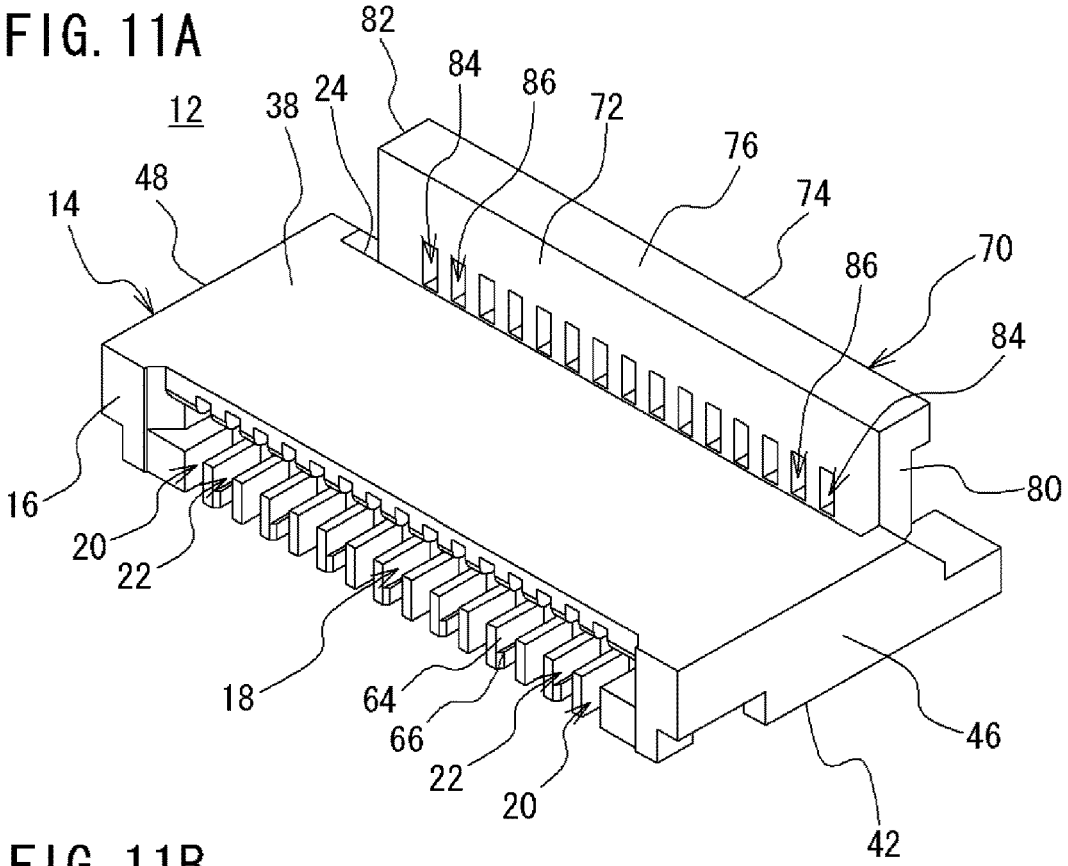
FIG. 11A is a perspective view from one side of a housing of the embodiment.
Figure 11B:
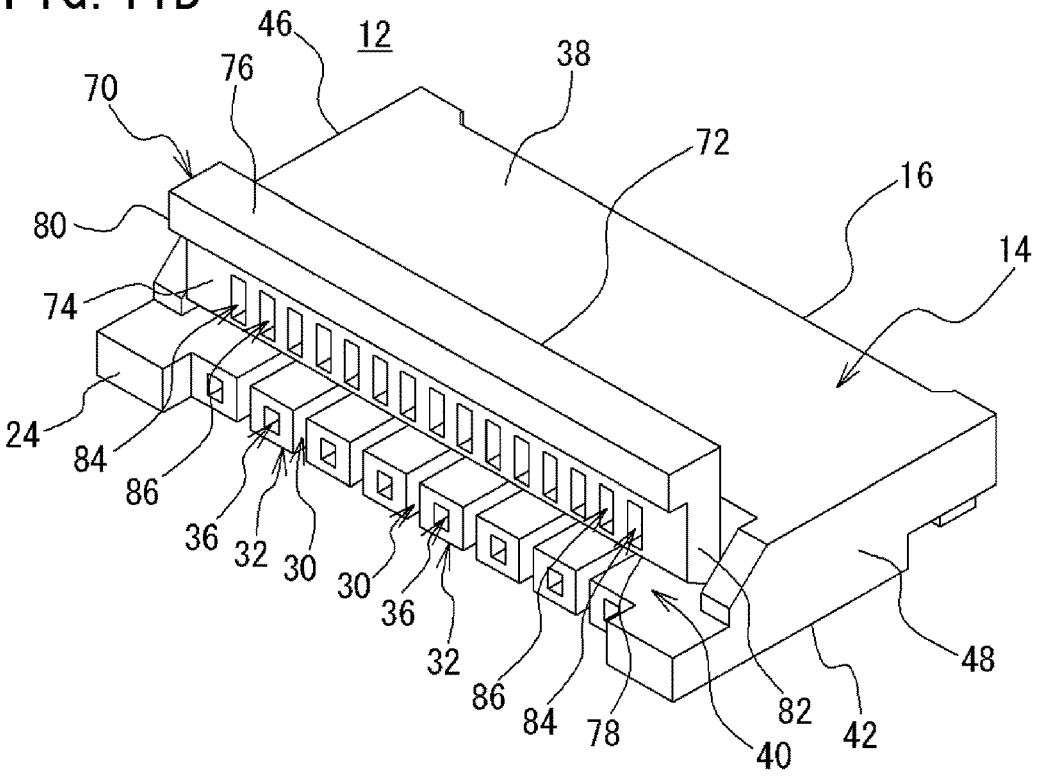
FIG. 11B is a perspective view from another side.
Figure 12A:
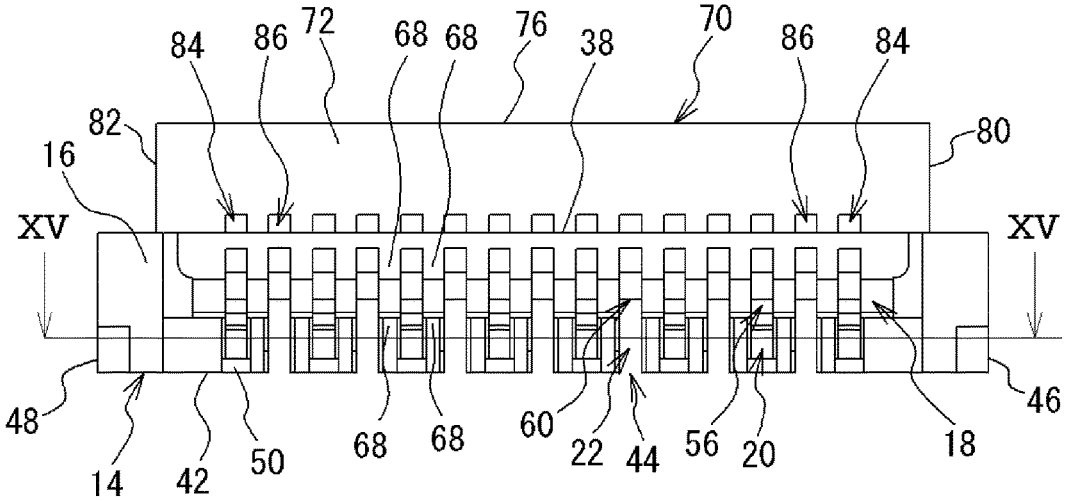
FIG. 12A is a front view of the housing of the embodiment.
Figure 12B:
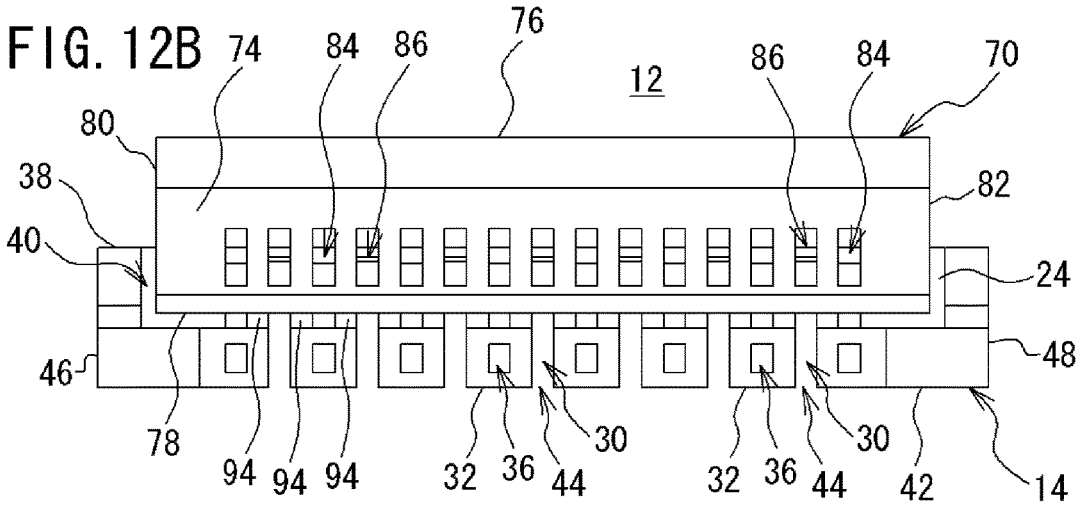
FIG. 12B is a rear view.
Figure 12C:
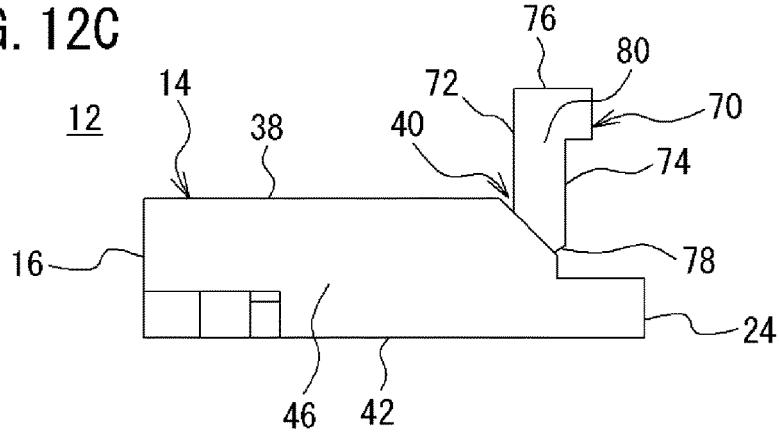
FIG. 12C is a side view from one side.
Figure 13A:
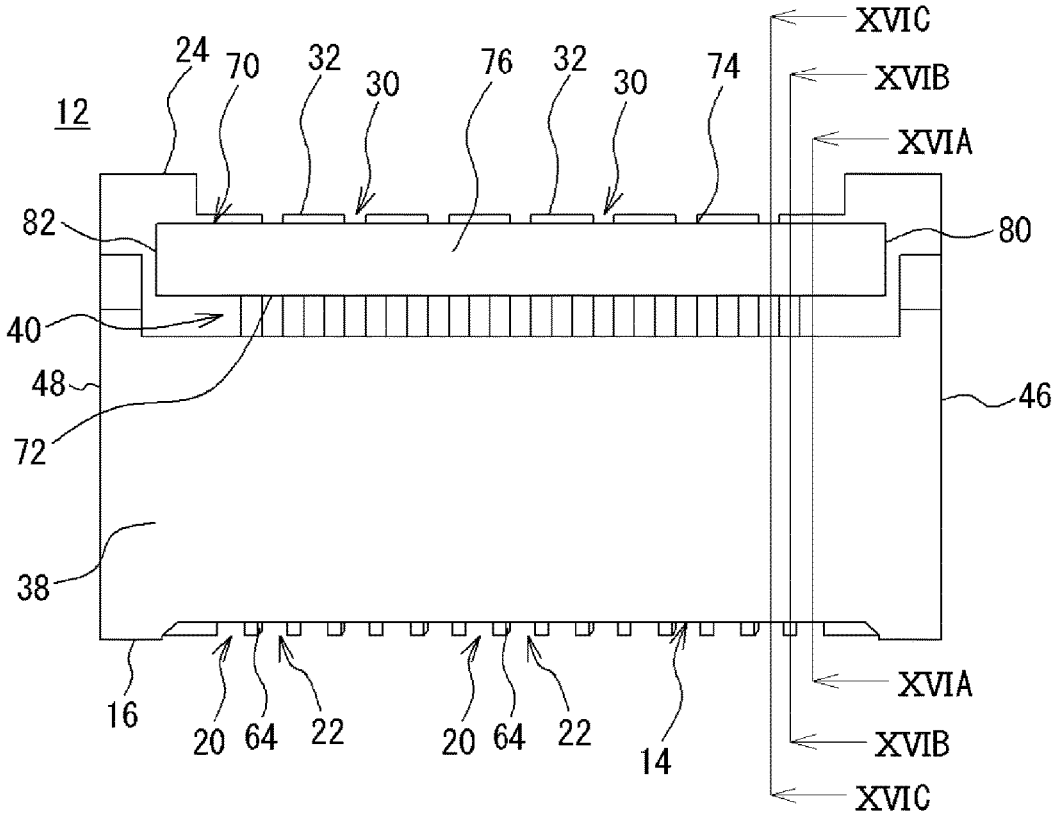
FIG. 13A is a plan view of the housing.
Figure 13B:
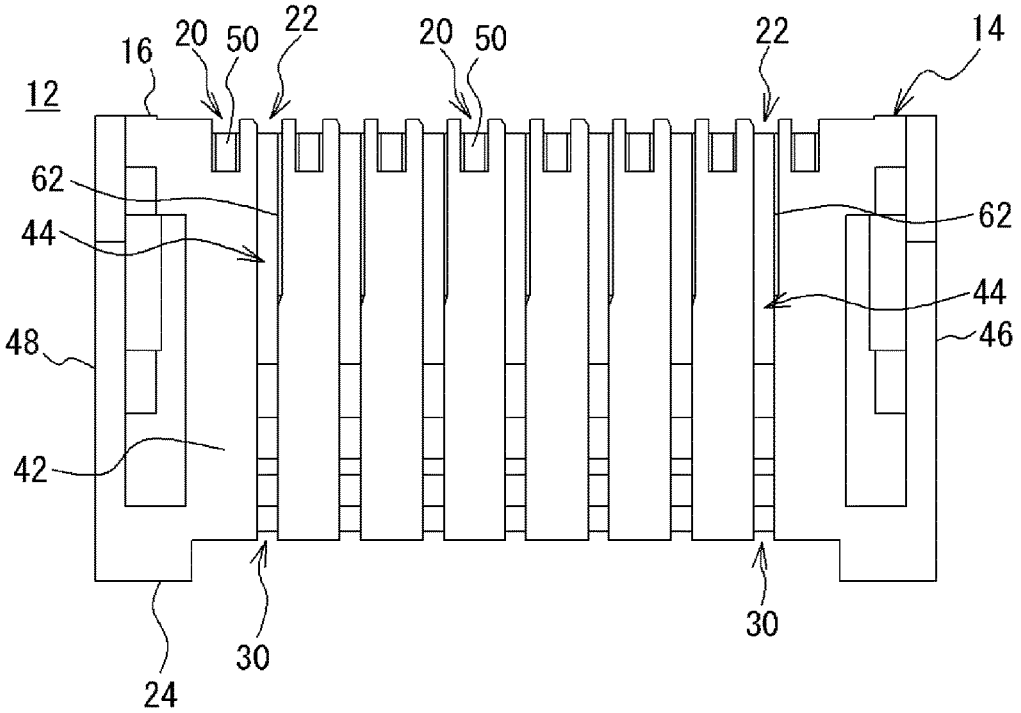
FIG. 13B is a bottom view.

In the supporting portion 150, a supporting protrusion 152 is formed protruding from a second surface side 174 that is another side, and is inserted into a recess portion 64 formed in the second contact accommodation portion 60 of the housing body 14 described later, and is hooked on a supporting groove portion 66 formed in the bottom surface 42 side of the recess portion 64, whereby the second contact 140 is supported in the second contact accommodation portion 60 (see FIG. 6).

In the second body portion 142, a second columnar portion 154 is formed extended upward, that is, toward the opposite direction to the side to which the second mounting portion 144 protrudes. Incidentally, in the embodiment, the second columnar portion 154 is perpendicular to the second body portion 142, and is extended from between the second mounting portion 144 and a substantially central portion of the second body portion 142, for example.

In the end portion of the opposite side to the second body portion 142 of the second columnar portion 154, a second arm portion 156 is extended toward the supporting portion 150 side along the second body portion 142. In addition, in the front end side of the second arm portion 156, an upper second contact portion 158 to be brought into contact with a conductor portion of the FPC 200 inserted is formed to protrude in a convex way to the second body portion 142 side.

Between the second body portion 142 and the second arm portion 156, a second intermediate arm portion 160 is formed extended along the second arm portion 156. In addition, the second intermediate arm portion 160 is formed to be slightly inclined toward the second arm portion 156. Further, in the end portion of the second intermediate arm portion 160, a lower second contact portion 162 is formed protruding in a convex way to the second arm portion 156 side. Incidentally, in the embodiment, the upper second contact portion 158 formed in the second arm portion 156 and the lower second contact portion 162 formed in the second intermediate arm portion 160 may be collectively referred to as the second contact portions 158 and 162. In addition, the second intermediate arm portion 160 is formed from a position close to the supporting portion 150, to be separated from the second columnar portion 154.

Incidentally, in the embodiment, the second press fitting portion 176 is formed in the second surface side 172 that is one side between the second columnar portion 154 and the second intermediate arm portion 160. In the second contact 140 of the embodiment, the second press fitting portion 176 is formed in the opposite side to the supporting protrusion 152; however, the second press fitting portion 176 may be formed in the second surface side 174 that is another side, or may be formed in the both surface sides 172 and 174.

In addition, similarly, not limited to the second surface side 174 that is the other side, the supporting protrusion 152 may be formed in the second surface side 172 that is one side or may be formed in the both surface sides 172 and 174.

Meanwhile, in the opposite side to the second arm portion 156 of the end portion of the second columnar portion 154, a second operating piece 166 is formed extended along the second body portion 142 of the second mounting portion 144 side. Incidentally, in the front end side of the second operating piece 166, a protruding portion 168 is formed more moderate than the first operating piece 122.

Between the second columnar portion 154 and the second mounting portion 144 of the second body portion 142, a second regulating protrusion portion 146 protruding toward the second operating piece 166 side is formed to protrude to the second columnar portion 154 side. In addition, a second protrusion portion 148 smaller than the second regulating protrusion portion 146 is formed in the second mounting portion 144 side. A space between the second operating piece 166, and the second protrusion portion 148 and the second regulating protrusion portion 146 of the second body portion 142 is a second pressing portion arrangement portion 170 in which a second pressing portion 90 formed in the operating portion 70 of the housing 12 described later is arranged (see FIG. 5C).

Figure 18B:
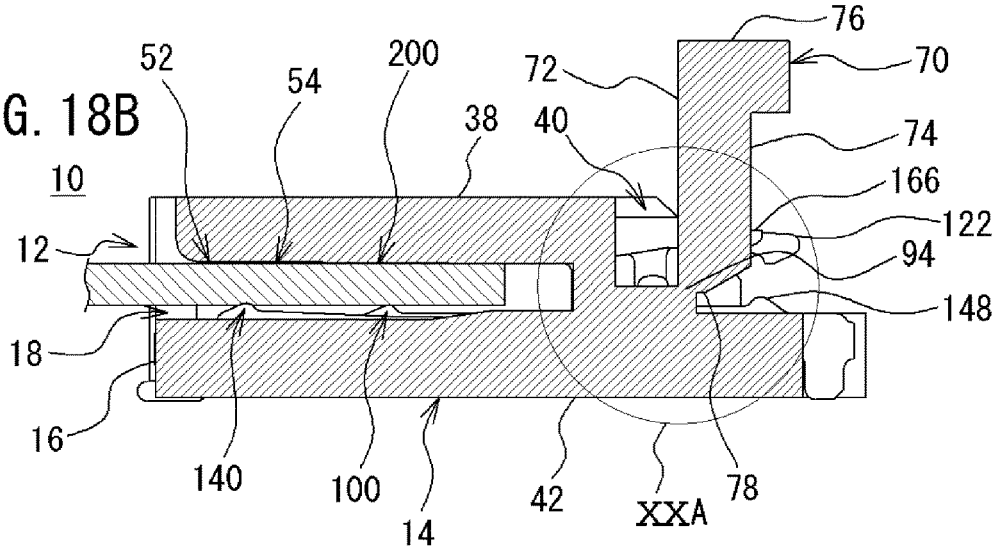
Figure 18C:
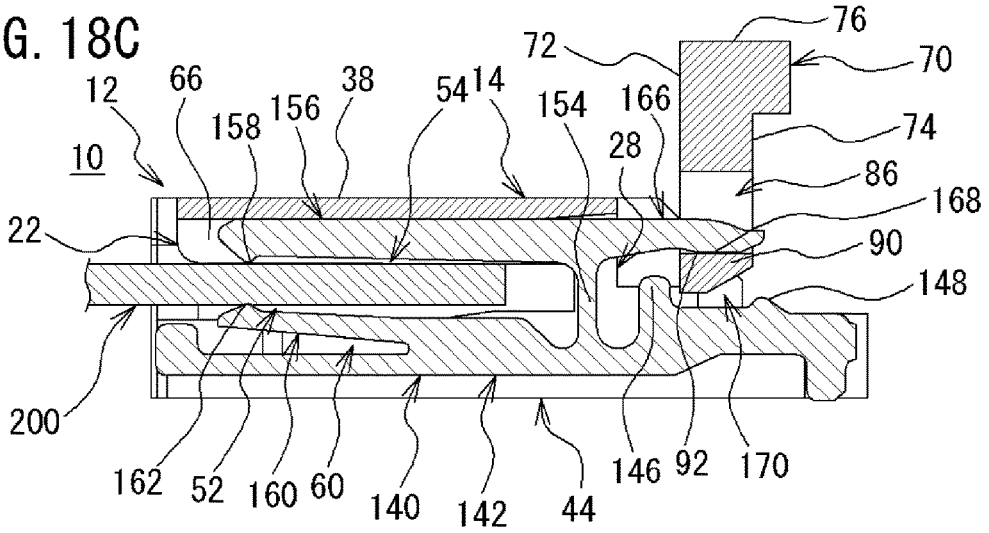
Figure 19B:
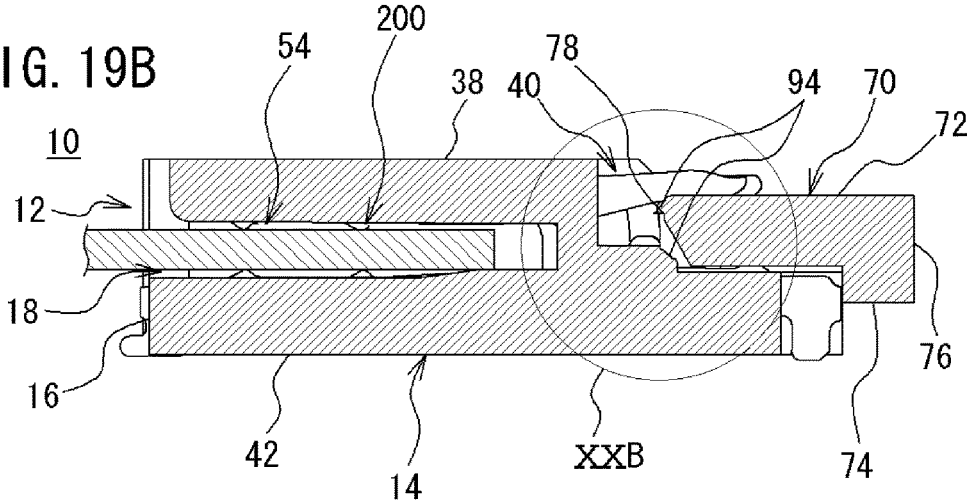
Figure 19C:
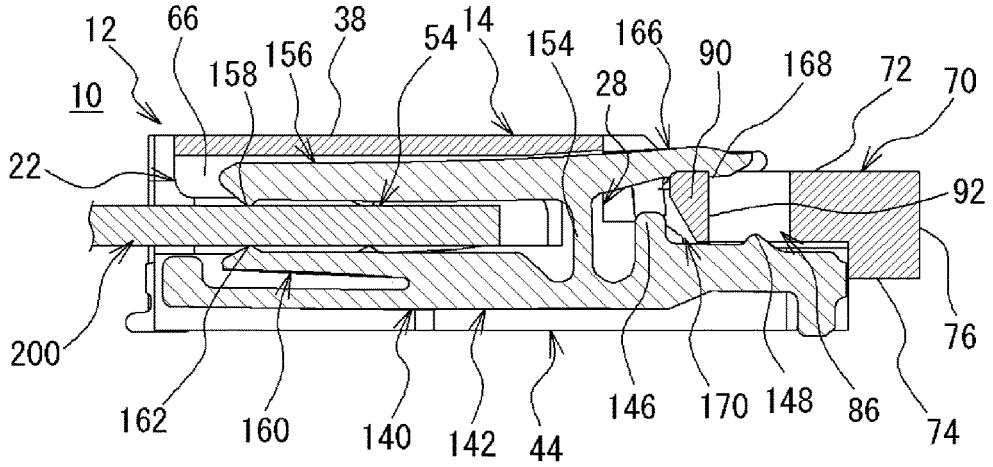

In the second contact 140, when the second operating piece 166 is pressed by the second pressing portion 90 formed in the operating portion 70 of the housing 12 in the direction opposite to the second body portion 142, the second arm portion 156 is moved to the second intermediate arm portion 160 side with the second columnar portion 154 as a pivot, and the FPC 200 is sandwiched between the upper second contact portion 158 of the second arm portion 156 and the lower second contact portion 162 of the second intermediate arm portion 160 (see FIG. 18C, FIG. 19C). Incidentally, details will be described later.

Next, the housing 12 of the embodiment will be described mainly with reference to FIGS. 11A and 11B to FIG. 15. The housing 12 of the embodiment includes the housing body 14 and the operating portion 70, and is formed of, for example, a resin material such that the housing body 14 and the operating portion 70 are integrated together. Incidentally, a portion in which the housing body 14 and the operating portion 70 are integrally connected together is a connection portion 94.

The housing body 14 includes: a front surface 16 in which the flat opening portion 18 into which the FPC 200 is inserted is formed, in one side; the rear surface 24 that is the opposite side to the front surface 16 and in which the operating portion 70 is arranged; a top surface 38 with a rectangular shape of a predetermined size; the bottom surface 42 arranged in the circuit board side; and one side surface 46 and another side surface 48. In addition, a corner portion between the top surface 38 and the rear surface 24 of the housing body 14 is cut out, and the operating portion 70 is structured to be integrated with a cut-out portion of the housing body 14 with the connection portion 94.

In the front surface 16 of the housing body 14, the flat opening portion 18 into which the FPC 200 is inserted is formed, and toward a direction perpendicular to the opening portion 18, that is, the top surface 38 side and the bottom surface 42 side, a first contact insertion slot 20 and a second contact insertion slot 22 with grooved-shapes into which the first contact 100 and the second contact 140 are respectively inserted, are alternately formed. Incidentally, the second contact insertion slot 22 into which the second contact 140 is inserted is formed across the bottom surface 42 of the housing body 14, and the bottom surface 42 side is cut out, and the cut-out portion communicates with an insertion groove portion 44 described later.

The rear surface 24 of the housing body 14 is formed step-wise such that the operating portion 70 can be provided, and is formed in two steps of the top surface 38 side and the bottom surface 42 side. In the top surface 38 side of the rear surface 24, a first protrusion slot 26 and a second protrusion slot 28 from which the first operating piece 122 of the first contact 100 and the second operating piece 166 of the second contact 140 respectively protrudes, are alternately formed.

In the bottom surface 42 side of the rear surface 24 corresponding to the first protrusion slot 26, the fixing portion 32 is formed apiece in which the fixing piece insertion hole 34 through which the fixing piece 106 of the first contact 100 is inserted and fixed is provided along an insertion direction of the first contact 100, and in the rear surface 24 of the fixing portion 32, an opening 36 is formed that communicates with the fixing piece insertion hole 34 of the fixing portion 32.

Meanwhile, in the bottom surface 42 side of the rear surface 24 corresponding to the second protrusion slot 28, a protrusion groove portion 30 is formed apiece from which the second mounting portion 144 of the second contact 140 protrudes. The protrusion groove portion 30 is formed in a groove shape cut out across from the bottom surface 42 to the top surface 38 side of the housing body 14. Incidentally, in both sides of the protrusion groove portion 30, each fixing portion 32 is provided, and a space between the fixing portion 32 and the other fixing portion 32 is the protrusion groove portion 30.

The top surface 38 of the housing body 14 includes a flat surface in the front surface 16 side, and in the rear surface 24 side, a cut-out portion 40 is formed cut out such that the operating portion 70 can be provided. The operating portion 70 is provided in the rear surface 24 side, which is lower, of the cut-out portion 40 of the top surface 38, and with the connection portion 94 provided in the top surface 38 side of each fixing portion 32, the operating portion 70 is integrally formed.

The bottom surface 42 of the housing body 14 has a predetermined area, and a plurality of grooves formed along an insertion direction of the second contact 140. The grooves are formed across from the front surface 16 to the rear surface 24 along the second contact accommodation portion 60 in which the second contact 140 is to be accommodated described later, and each are the insertion groove portion 44 for the second mounting portion 144 of the second contact 140 to pass through when the second contact 140 is accommodated in the housing body 14.

As illustrated in FIGS. 14A to 14C, and FIG. 15, an internal space 52 is formed inside the housing body 14, and the internal space 52 includes an arrangement portion 54 in which the FPC 200 inserted is to be arranged, the first contact accommodation portion 56 in which the first contact 100 is to be accommodated, and the second contact accommodation portion 60 in which the second contact 140 is to be accommodated.

The arrangement portion 54 of the internal space 52 communicates with the opening portion 18 formed in the front surface 16, the first contact accommodation portion 56 communicates with the first contact insertion slot 20, and the second contact accommodation portion 60 communicates with the second contact insertion slot 22.

Further, the first contact accommodation portion 56 is connected to each of the fixing piece insertion hole 34 and the first protrusion slot 26 of the rear surface 24, and the second contact accommodation portion 60 is connected to each of the protrusion groove portion 30 and the second protrusion slot 28 of the rear surface 24, and the insertion groove portion 44 of the bottom surface 42.

The first contact accommodation portion 56 and the second contact accommodation portion 60 are alternately formed, and between the first contact accommodation portion 56 and the second contact accommodation portion 60, a partition wall 68 by which each space is partitioned is formed along the insertion directions of the first contact 100 and the second contact 140. Incidentally, the first contact accommodation portion 56 and the second contact accommodation portion 60 are formed by cutting out the partition wall 68 of a portion corresponding to the arrangement portion 54 into which the FPC 200 is inserted.

For that reason, in the internal space 52, the first contact insertion slot 20, the first contact accommodation portion 56, the first protrusion slot 26, and the fixing piece insertion hole 34 are connected to each other, whereby the first contact 100 is inserted and accommodated. In addition, the second contact insertion slot 22, the second contact accommodation portion 60, the second protrusion slot 28, the protrusion groove portion 30, and the insertion groove portion 44 are connected to each other, whereby the second contact 140 is inserted and accommodated.

Further, in the internal space 52, the arrangement portion 54, the first contact accommodation portion 56, and the second contact accommodation portion 60 are connected to each other, whereby a plurality of the first contacts 100 and the second contacts 140 accommodated in the housing body 14 and the FPC 200 inserted into the housing 12 are connected to each other.

Incidentally, in the first contact accommodation portion 56, a first wide groove portion 58 wider than a width sandwiched by the partition wall 68 of the other first contact accommodation portion 56 is formed in the first contact insertion slot 20 side. The first wide groove portion 58 is a portion for the first press fitting portion 134 formed in the first contact 100 to pass through without being press-fitted up to a predetermined position. In addition, in the embodiment, the first wide groove portion 58 is formed in each partition wall 68 of both sides sandwiching the first contact accommodation portion 56.

In the second contact accommodation portion 60, the recess portion 64 through which the supporting protrusion 152 formed in the supporting portion 150 of the second contact 140 passes is formed in the second contact insertion slot 22 side, and the supporting groove portion 66 by which the supporting protrusion 152 is supported is formed. The recess portion 64 is a portion which the supporting protrusion 152 is inserted through and arranged in, when the second contact 140 is inserted into the second contact accommodation portion 60, and the supporting protrusion 152 is supported by the supporting groove portion 66 formed in the rear surface 24 side.

Further, in the partition wall 68 of the opposite side to the recess portion 64 of the second contact accommodation portion 60, a second wide groove portion 62 is formed through which the second press fitting portion 176 of the second contact 140 passes. The second wide groove portion 62, similarly to the first wide groove portion 58, is a structure for the second press fitting portion of the second contact 140 to pass through without being press-fitted up to a predetermined position. Incidentally, the second wide groove portion 62 is formed to be longer than the recess portion 64, toward the rear surface 24 side.

The operating portion 70, as illustrated in FIGS. 11A and 11B to FIGS. 14A to 14C, is formed in a substantially rectangular parallelepiped shape including: a front surface portion 72 provided in the front surface 16 side of the housing body 14; a rear surface portion 74 provided in the rear surface 24 side of the housing body 14 that is the opposite side to the front surface portion 72; a top surface portion 76 that is provided in the top surface 38 side of the housing body 14 and is an apex stood; a bottom surface portion 78 provided in the housing body 14 side; and one side surface portion 80 and another side surface portion 82. Incidentally, the connection portion 94 is formed in the bottom surface portion 78 of the operating portion 70, and the operating portion 70 is connected to and integrally formed with the housing body 14.

In the bottom surface portion 78 side of the operating portion 70, a plurality of through holes is formed across from the front surface portion 72 to the rear surface portion 74. The plurality of through holes includes a first through hole 84 formed in a position corresponding to the first protrusion slot 26 formed in the rear surface 24 of the housing body 14 and a second through hole 86 formed in a position corresponding to the second protrusion slot 28. The first operating piece 122 of the first contact 100 accommodated in the first contact accommodation portion 56 of the housing body 14 is inserted into the first through hole 84 corresponding to the first protrusion slot 26, and the second operating piece 166 of the second contact 140 accommodated in the second contact accommodation portion 60 of the housing body 14 is inserted into the second through hole 86 corresponding to the second protrusion slot 28. Incidentally, the first through hole 84 and the second through hole 86 may be collectively referred to as through holes 84 and 86.

Figure 14A:
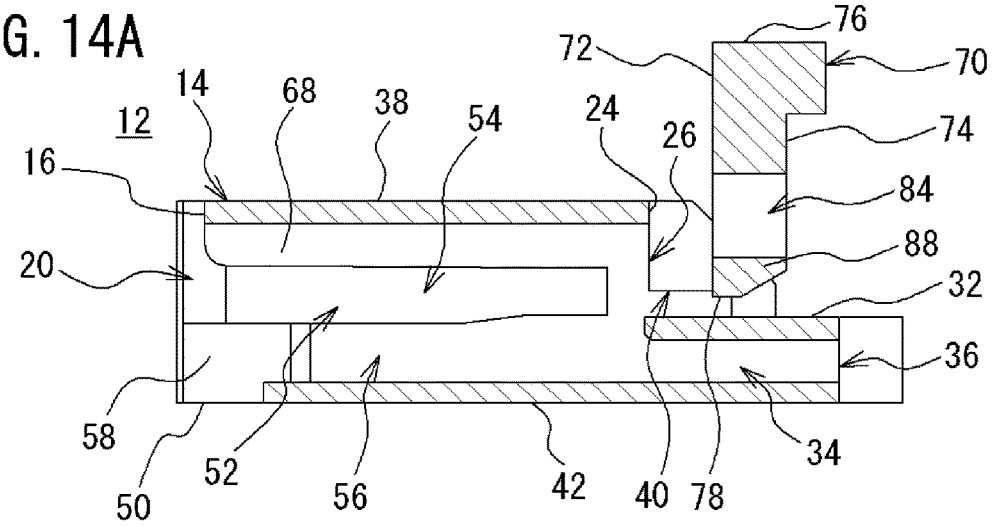
FIG. 14A is a sectional view along a line XVIA-XVIA of FIG. 13A.
Figure 14B:
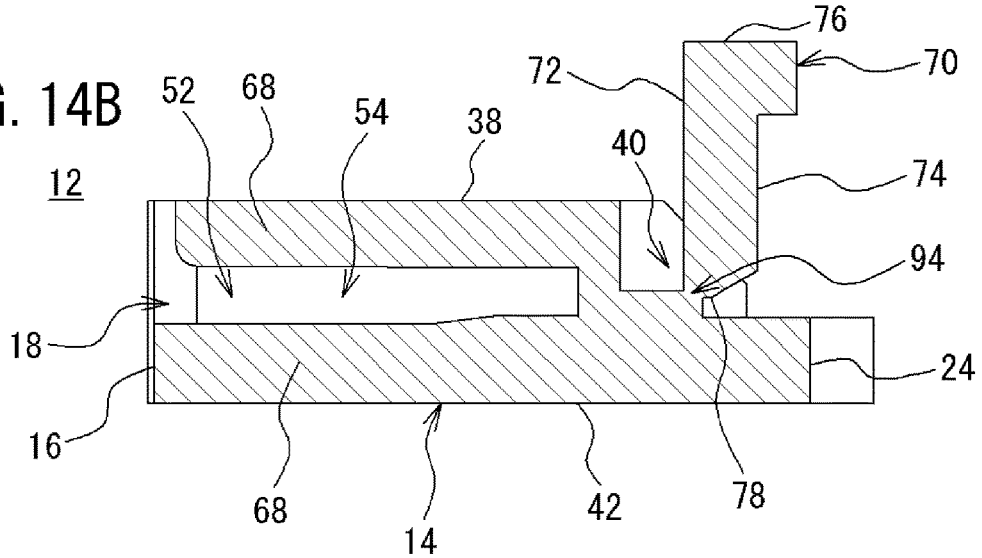
FIG. 14B is a sectional view along a line XVIB-XVIB of FIG. 13A.
Figure 14C:
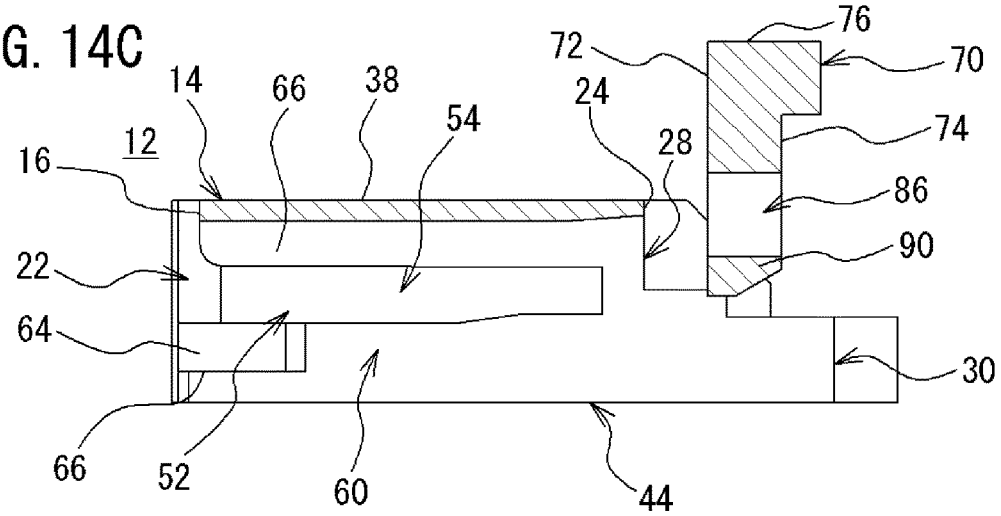
FIG. 14C is a sectional view along a line XVIC-XVIC of FIG. 13A.
Figure 15:
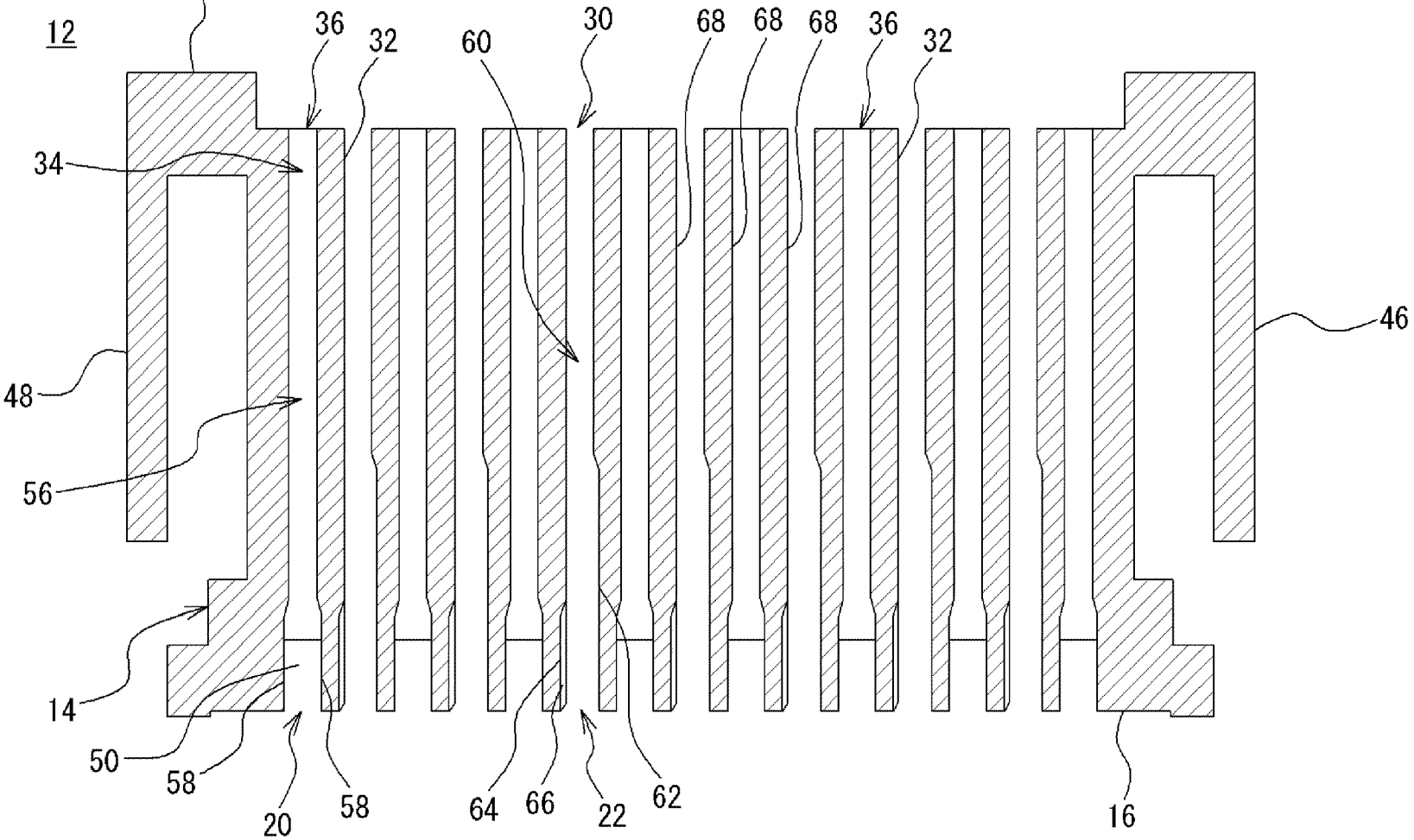
FIG. 15 is a sectional view along a line XV-XV of FIG. 12A.

A portion between the first through hole 84 and the bottom surface portion 78 of the operating portion 70, and a portion between the second through hole 86 and the bottom surface portion 78 of the operating portion 70 are respectively the first pressing portion 88 and the second pressing portion 90. In the first pressing portion 88 and the second pressing portion 90, as illustrated in FIGS. 14A to 14C, the bottom surface portion 78 side is longer than the front surface portion 72 side and the rear surface portion 74 side, and the cross section is rectangular. Incidentally, in the embodiment, the rear surface portion 74 side is formed to be inclined from the bottom surface portion 78.

The first pressing portion 88 is arranged in the first pressing portion arrangement portion 128 of the first contact 100 when the first contact 100 is mounted, and the second pressing portion 90 is arranged in the second pressing portion arrangement portion 170 of the second contact 140 when the second contact 140 is mounted (see FIGS. 5A to 5C).

Incidentally, regarding the first pressing portion 88 and the second pressing portion 90 of the operating portion 70, in a case where the FPC 200 is not inserted, a longitudinal portion 92 of each of the first pressing portion 88 and the second pressing portion 90 is arranged in a lying state, and in a case where the FPC 200 is mounted and the operating portion 70 is operated, the longitudinal portion 92 of each of the first pressing portion 88 and the second pressing portion 90 is in an upright state, and the first operating piece 122 and the second operating piece 166 are pressed upward (see FIGS. 18A to 18C, FIGS. 19A to 19C).

The connection portion 94 connecting the housing body 14 and the operating portion 70 together, as illustrated in FIGS. 11A and 11B to FIGS. 14A to 14C, is formed to be connected to portions that are in the bottom surface portion 78 side of the operating portion 70 and in which the first through hole 84 and the second through hole 86 in the bottom surface portion 78 side of the operating portion 70 are provided, that is, portions other than the first pressing portion 88 and the second pressing portion 90. For that reason, the connection portion 94 is formed for each space between the first contact 100 and the second contact 140 mounted to the housing body 14. Incidentally, the connection portion 94 is formed in the top surface 38 side of each fixing portion 32 in the rear surface 24 side of the housing body 14.

Next, assembly will be described of the connector 10 according to the embodiment mainly with reference to FIGS. 1A and 1B, FIG. 2, FIGS. 16A to 16C, and FIGS. 17A to 17C. Assembly of the connector 10 is performed by mounting the first contact 100 and the second contact 140 to the housing body 14, and the mounting is performed by inserting the first contact 100 and the second contact 140 respectively into the first contact insertion slot 20 and the second contact insertion slot 22 formed in the front surface 16 of the housing body 14, and accommodating the contacts in the respective first contact accommodation portion 56 and the second contact accommodation portion 60 inside the housing body 14 (see FIGS. 1A and 1B, FIG. 2).

Figure 16A:
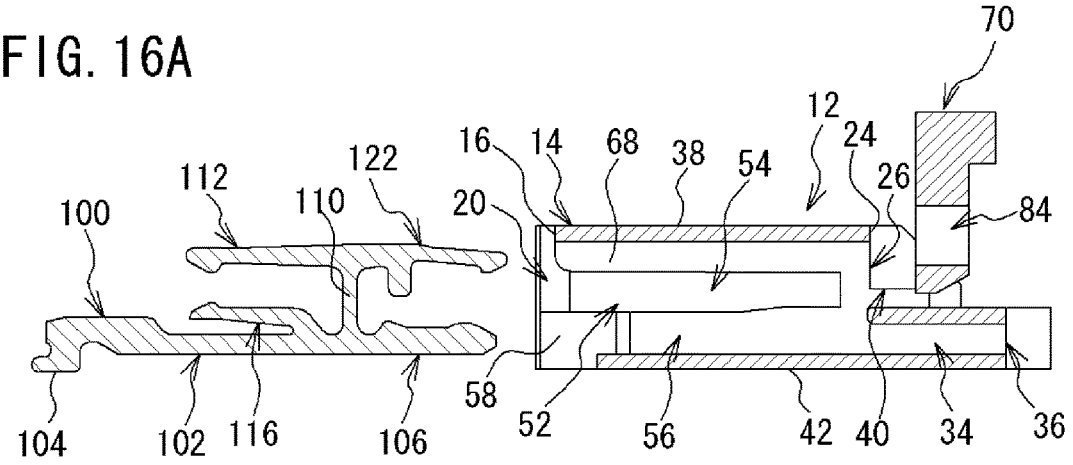
FIGS. 16A to 16C are sectional views corresponding to FIG. 5A illustrating a process of mounting the first contact to the housing.

First, insertion of the first contact 100 into the housing body 14 will be described with reference to FIGS. 16A to 16C. In insertion of the first contact 100 into the housing body 14, as illustrated in FIG. 16A, with the first operating piece 122 and the fixing piece 106 of the front end side of the first contact 100 at the front, the first contact 100 is inserted from the first contact insertion slot 20 formed in the front surface 16 of the housing body 14.

Figure 16B:
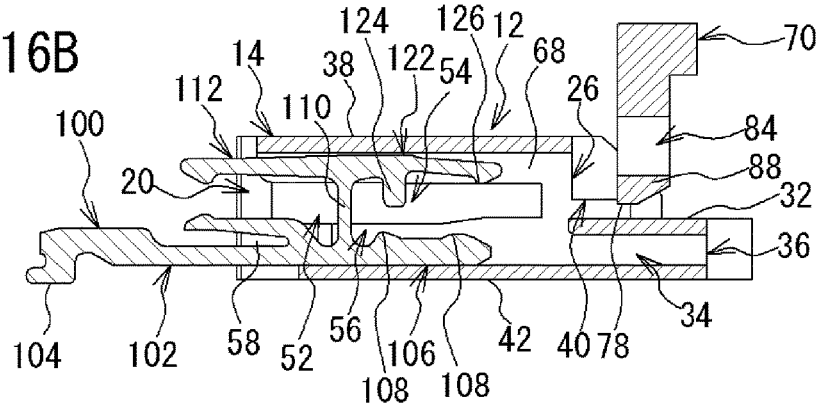

When the first contact 100 is inserted into the first contact accommodation portion 56 of the housing body 14, as illustrated in FIG. 16B, the fixing piece 106 and the first body portion 102 of the first contact 100 pass through the inside of the bottom surface 42 of the housing body 14, and the first arm portion 112 and the first operating piece 122 of the first contact 100 pass through the inside of the top surface 38 of the housing body 14.

Further, the both surface sides 130 and 132 of the first contact 100 pass between the partition walls 68 that partition the first contact accommodation portion 56. At this time, the first press fitting portion 134 formed in the first surface side 130 that is one side of the first contact 100, passes through the first wide groove portion 58 formed from the first contact insertion slot 20 side of the first contact accommodation portion 56.

Figure 16C:
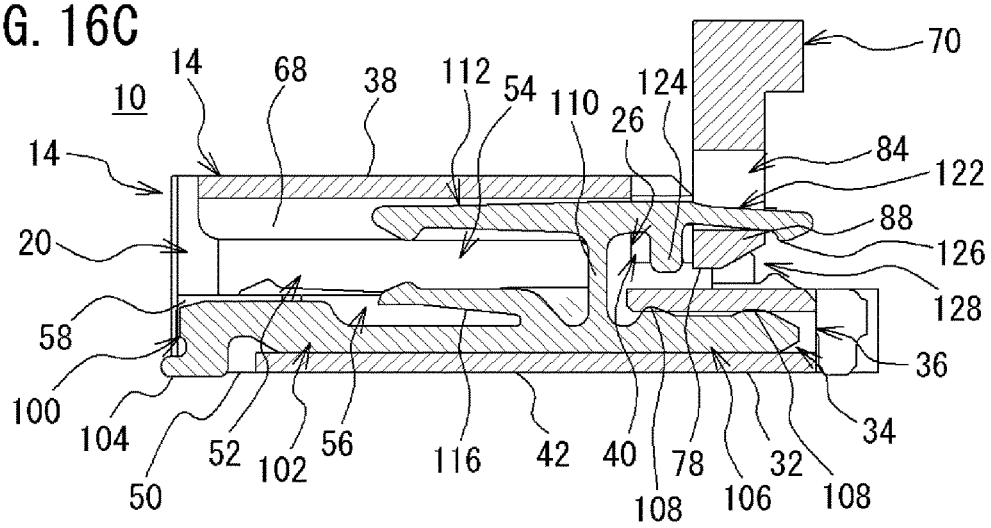

After that, the first contact 100 is further inserted into the first contact accommodation portion 56 of the housing body 14, and is moved to a predetermined position, as illustrated in FIG. 16C, whereby the first contact 100 is mounted to the first contact accommodation portion 56.

At this time, the first operating piece 122 of the first contact 100 protrudes from the first protrusion slot 26 of the rear surface 24 of the housing body 14, and is arranged in a position where the first operating piece 122 has passed through the first through hole 84 formed in the operating portion 70. Incidentally, the first pressing portion 88 of the operating portion 70 is arranged in the first pressing portion arrangement portion 128 that is above the fixing portion 32 of the housing body 14 and between the first regulating protrusion portion 124 and the first protrusion portion 126 of the first operating piece 122 of the first contact 100.

The fixing piece 106 of the first contact 100 is inserted into the fixing piece insertion hole 34 inside the fixing portion 32 formed in the rear surface 24 side of the housing body 14, and each of the fixing protrusion portions 108 formed in the fixing piece 106 is press-fitted, whereby the fixing piece 106 side of the first contact 100 is positioned and fixed. Incidentally, the fixing piece 106 does not protrude from the opening 36 of the fixing portion 32.

Further, the first press fitting portion 134 formed in the first surface side 130 that is one side of the first contact 100, passes through the first wide groove portion 58, and then is press-fitted into the partition wall 68 of the first contact accommodation portion 56.

When the first contact 100 is mounted to the first contact accommodation portion 56, the first mounting portion 104 of the first contact 100 is arranged in a front side open portion 50 formed in the front surface 16 side of the housing body 14, and the end portion of the circuit board side of the first mounting portion 104 protrudes from the bottom surface 42 of the housing body 14. By the above, the first contact 100 is accommodated in the housing 12.

Figure 17A:
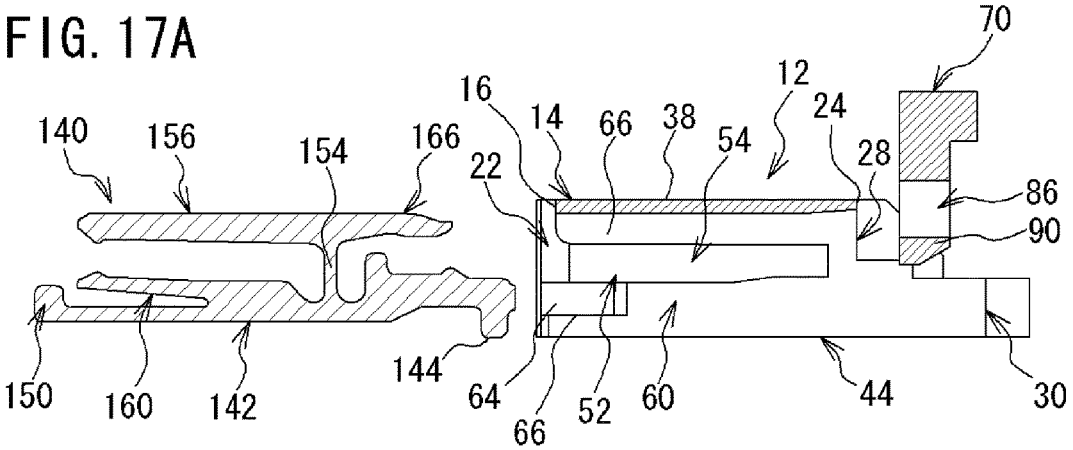
FIGS. 17A to 17C are sectional views corresponding to FIG. 5C illustrating a process of mounting the second contact to the housing.

Next, insertion of the second contact 140 into the housing body 14 will be described with reference to FIGS. 17A to 17C. In insertion of the second contact 140 into the housing body 14, as illustrated in FIG. 17A, with the second operating piece 166 and the second mounting portion 144 of the front end side of the second contact 140 at the front, the second contact 140 is inserted from the second contact insertion slot 22 formed in the front surface 16 of the housing body 14.

Figure 17B:
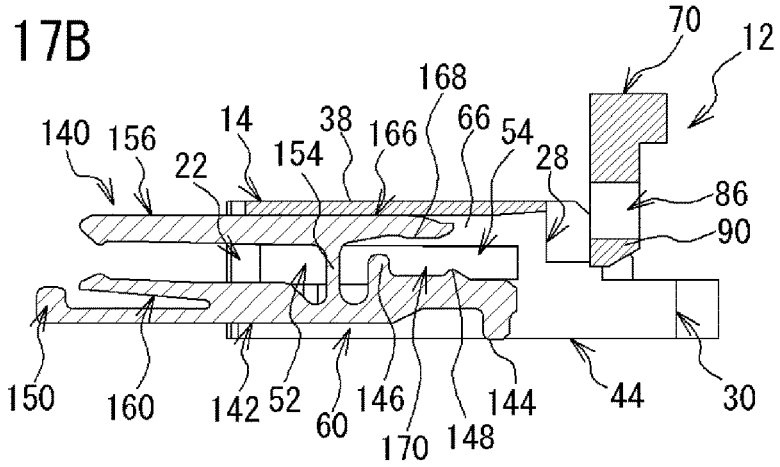

When the second contact 140 is inserted into the second contact accommodation portion 60 of the housing body 14, as illustrated in FIG. 17B, the second body portion 142 of the second contact 140 passes through the bottom surface 42 side of the housing body 14, and the second mounting portion 144 passes through the insertion groove portion 44 formed in the bottom surface 42, and also the second arm portion 156 and the second operating piece 166 of the second contact 140 pass through the inside of the top surface 38 of the housing body 14.

Further, the both surface sides 172 and 174 of the second contact 140 pass between the partition walls 68 that partition the second contact accommodation portion 60. At this time, the second press fitting portion 176 formed in the second surface side 172 that is one side of the second contact 140, passes through the second wide groove portion 62 formed from the second contact insertion slot 22 side of the second contact accommodation portion 60.

Figure 17C:
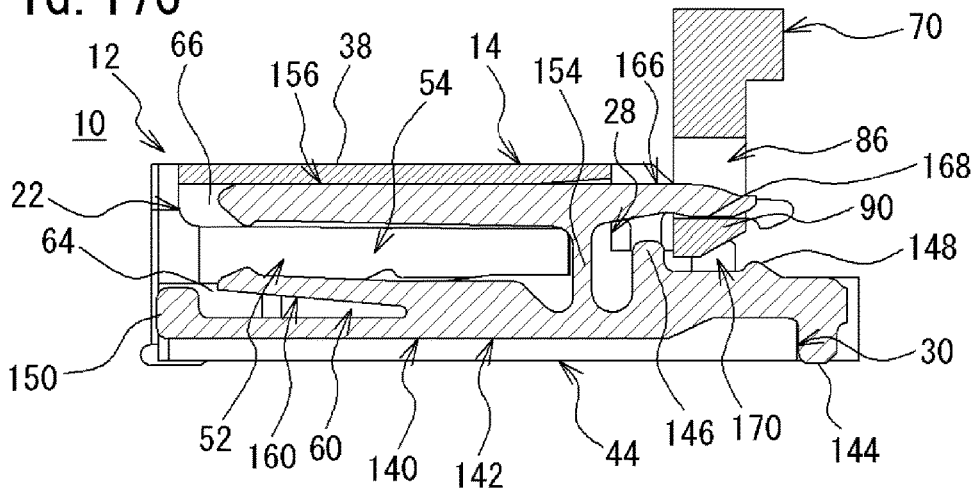

After that, the second contact 140 is further inserted into the second contact accommodation portion 60 of the housing body 14, and is moved to a predetermined position, as illustrated in FIG. 17C, whereby the second contact 140 is mounted to the second contact accommodation portion 60.

At this time, the second operating piece 166 of the second contact 140 protrudes from the second protrusion slot 28 of the rear surface 24 of the housing body 14, and is arranged in a position where second operating piece 166 has passed through the second through hole 86 formed in the operating portion 70. Incidentally, the second pressing portion 90 of the operating portion 70 is arranged in the second pressing portion arrangement portion 170 that is below the second operating piece 166 of the second contact 140 and between the second regulating protrusion portion 146 and the second protrusion portion 148 of the second mounting portion 144 side of the second body portion 142. In addition, the second pressing portion 90 is also arranged between the protruding portion 168 and the second columnar portion 154 of the second operating piece 166.

The second mounting portion 144 of the second contact 140 protrudes from the protrusion groove portion 30 formed in the rear surface 24 side of the housing body 14, and the second mounting portion 144 protrudes from the bottom surface 42 side.

Further, the supporting protrusion 152 formed in the second surface side 174 that is the other side of the second contact 140, is arranged after going through the recess portion 64 formed from the second contact insertion slot 22 side of the second contact accommodation portion 60, and the supporting protrusion 152 of the second contact 140 is supported by the supporting groove portion 66 below the recess portion 64 of the housing body 14, and the second operating piece 166 is supported by the second pressing portion 90 of the operating portion 70.

Further, the second press fitting portion 176 formed in the second surface side 172 that is one side of the second contact 140, passes through the second wide groove portion 62, and then is press-fitted into the partition wall 68 of the second contact accommodation portion 60. By the above, the second contact 140 is accommodated in the housing 12.

As described above, the first contact 100 and the second contact 140 are accommodated in the housing 12, whereby assembly of the connector 10 of the embodiment is ended. At this time, the housing 12 is formed in a state where the housing body 14 and the operating portion 70 are integrated together and are connected together by the connection portion 94. In addition, the first mounting portion 104 of the first contact 100 and the second mounting portion 144 of the second contact 140 are each in a state of protruding from the bottom surface 42 side of the housing body 14 toward the circuit board side.

Incidentally, in assembly of the connector 10 according to the embodiment, insertion of the first contact 100 and the second contact 140 into the housing 12 may be collectively performed at one time, and may be performed by being divided into a plurality of times, and further, may be performed one by one.

In a case where the connector 10 assembled is mounted to the circuit board, the first mounting portion 104 of the first contact 100 and the second mounting portion 144 of the second contact 140 are mounted at predetermined positions on the circuit board by soldering or the like, and fixed.

Next, connection of the FPC 200 to the connector 10 will be described mainly with reference to FIGS. 18A to 18C to FIGS. 20A and 20B. In the connection, first, the FPC 200 is inserted from the opening portion 18 formed in the front surface 16 of the housing body 14 in the housing 12 of the connector 10, and is arranged in a predetermined position of the arrangement portion 54 inside the housing body 14, as illustrated in FIGS. 18A to 18C. At this time, the FPC 200 is arranged such that conductor portions (not illustrated) formed in the FPC 200 correspond to the first contact portions 114 and 118 of the first contact 100, and the second contact portions 158 and 162 of the second contact 140. Incidentally, in a state where the FPC 200 is inserted into the housing 12 and arranged in the predetermined position, the FPC 200 is not sandwiched by the first contact 100 and the second contact 140, and is in a state of easily coming off.

After that, as illustrated in FIGS. 19A to 19C, the operating portion 70 of the housing 12 is operated, and the FPC 200 is sandwiched by the first contact 100 and the second contact 140. This operation is performed by moving the operating portion 70 with reference to the pressing portions 88 and 90 of the operating portion 70 such that the operating portion 70 shifts from a state of being stood to a state of being substantially parallel with respect to the housing body 14.

Figure 20A:
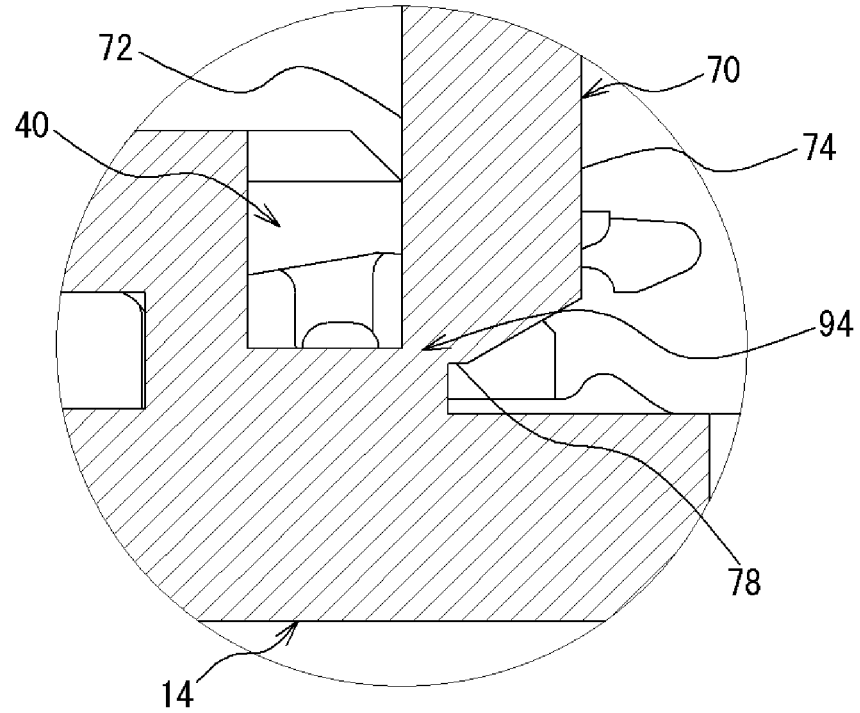
FIG. 20A is an enlarged view of a portion XXA of FIG. 18A.
Figure 20B:
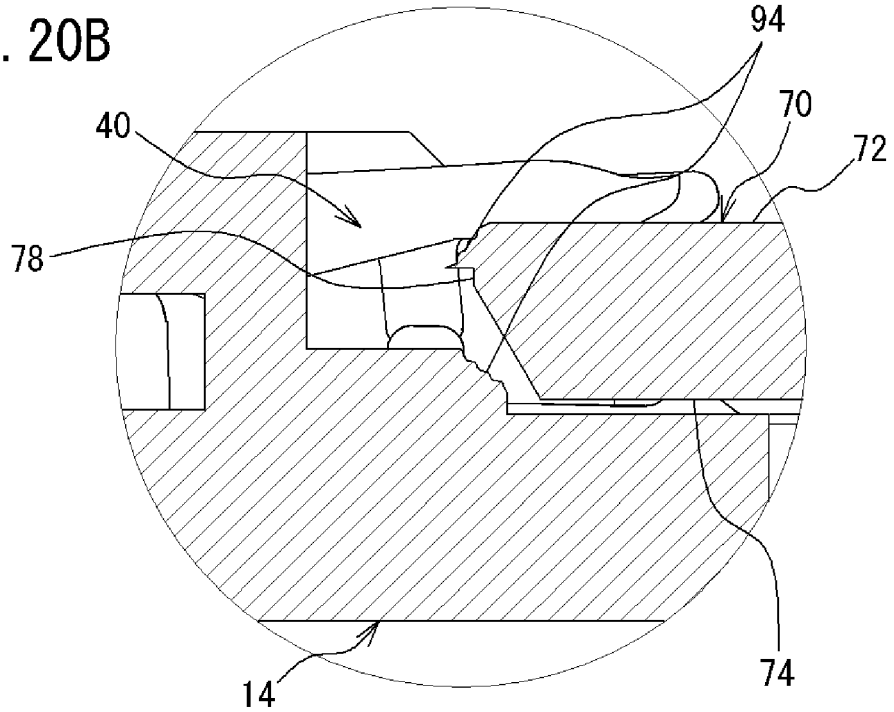
FIG. 20B is an enlarged view of a portion XXB of FIG. 19A.

When the operating portion 70 is operated, the connection portion 94 by which the operating portion 70 and the housing body 14 are connected together is cut off, and the housing body 14 and the operating portion 70 are in a state of being separated (see FIGS. 20A and 20B). Further, the operating portion 70 is operated, whereby the longitudinal portion 92 parallel to the top surface portion 76 and the bottom surface portion 78 of the first pressing portion 88 and the second pressing portion 90 of the operating portion 70, is moved to stand up, and the first operating piece 122 of the first contact 100 and the second operating piece 166 of the second contact 140 are pressed upward. For that reason, the first operating piece 122 and the second operating piece 166 are pressed, whereby the first arm portion 112 and the second arm portion 156 are respectively moved to the first intermediate arm portion 116 side and the second intermediate arm portion 160 side with the first columnar portion 110 and the second columnar portion 154 as pivots, and conductor portions of the FPC 200 are respectively sandwiched between the upper first contact portion 114 and the lower first contact portion 118, and between the upper second contact portion 158 and the lower second contact portion 162.

At this time, the first contact portions 114 and 118 of the first contact 100, and the second contact portions 158 and 162 of the second contact 140 are brought into contact with the conductor portions of the FPC 200, and sandwich the FPC 200, whereby the FPC 200 is prevented from coming off. By the above, connection of the FPC 200 to the connector 10 is completed.

In a case where the FPC 200 is removed, the operating portion 70 is moved in the opposite direction, that is, moved to be perpendicular to the housing body 14. With this movement, the longitudinal portion 92 of each of the first pressing portion 88 and the second pressing portion 90 of the operating portion 70 is in a lying state, and pressing is released to the first operating piece 122 of the first contact 100 and the second operating piece 166 of the second contact 140 of the respective first pressing portion 88 and second pressing portion 90.

The first operating piece 122 and the second operating piece 166 are respectively moved to the first body portion 102 side and the second body portion 142 side with the first columnar portion 110 and the second columnar portion 154 as pivots, whereby the first arm portion 112 and the second arm portion 156 are moved in directions to be opened, and the first contact portions 114 and 118 of the first contact 100 and the second contact portions 158 and 162 of the second contact 140 are separated from the FPC 200, and contact to the conductor portion of the FPC 200 is released. After that, by pulling out the FPC 200, the FPC 200 can be removed from the connector 10.

Incidentally, in the embodiment, a case has been described where the plurality of first contacts 100 and second contacts 140 are used as the plurality of contacts; however, not limited thereto, only the plurality of first contacts 100 may be provided, or only the plurality of second contacts 140 may be provided.

In the embodiment, cutting off between the housing body 14 of the housing 12 and the connection portion 94 of the operating portion 70 has been performed by operating the operating portion 70 during connection to the FPC 200; however, not limited thereto, the cutting off may be performed during assembly of the connector 10. For example, when the first contact 100 and the second contact 140 are inserted into the housing body 14, by the first regulating protrusion portion 124 of the first contact 100 and the second regulating protrusion portion 146 of the second contact 140, the first pressing portion 88 and the second pressing portion 90 of the operating portion 70 are pressed in the insertion direction, whereby the connection portion 94 can be cut off.

Incidentally, the operating portion 70 cut off and separated, hooks on the first protrusion portion 126 of the first operating piece 122 of the first contact 100, thereby being prevented from coming off. In addition, the operating portion 70 of the housing 12 cut off and separated, can be repeatedly operated in a state of being separated, and connection and disconnection can be performed between the FPC 200 and the connector 10.

Further, in the embodiment, the connection portion 94 connecting the operating portion 70 and the housing body 14 of the housing 12 together is provided for all portions corresponding to the first pressing portion 88 and the second pressing portion 90 of the operating portion 70; however, not limited thereto, the connection portion 94 may be provided in a part of the portions if the housing body 14 and the operating portion 70 are in a state of being connected together in a case where the housing 12 is formed.

What is claimed is:

1. A housing to which a plurality of contacts each making connection by sandwiching a connecting member is mounted, the housing comprising:
- a housing body in which the contacts are to be accommodated; and
- an operating portion that moves the contacts accommodated in the housing body such that the contacts sandwich the connecting member, wherein,
- in a case where the contacts sandwich the connecting member, a portion in which the housing body and the operating portion are connected together is cut off when the operating portion is operated.

2. A housing to which a plurality of contacts each making connection by sandwiching a connecting member is mounted, the housing comprising:
- a housing body in which the contacts are to be accommodated; and
- an operating portion that moves the contacts accommodated in the housing body such that the contacts sandwich the connecting member, wherein,
- during mounting of the contacts, a portion in which the housing body and the operating portion are connected together is cut off when the operating portion is pressed.

3. The housing according to claim 1, wherein
- the housing body includes an opening portion into which the connecting member is inserted,
- a side of the opening portion of the housing body includes a contact insertion slot into which each of the contacts is inserted, and
- the operating portion is provided in an opposite side to the contact insertion slot of the housing body.

4. The housing according to claim 2, wherein
- the housing body includes an opening portion into which the connecting member is inserted,
- a side of the opening portion of the housing body includes a contact insertion slot into which each of the contacts is inserted, and
- the operating portion is provided in an opposite side to the contact insertion slot of the housing body.

5. A connector comprising:

a plurality of contacts each making connection by sandwiching a connecting member; and a housing in which the contacts are to be accommodated, wherein the housing includes a housing body in which the contacts are to be accommodated, and an operating portion that moves the contacts such that the contacts perform sandwiching, and, in a case where the contacts sandwich the connecting member, a portion in which the housing body and the operating portion are connected together is cut off when the operating portion is operated.

6. A connector comprising:

a plurality of contacts each making connection by sandwiching a connecting member; and a housing in which the contacts are to be accommodated, wherein the housing includes a housing body in which the contacts are to be accommodated, and an operating portion that moves the contacts such that the contacts perform sandwiching, and, during mounting of the contacts, a portion in which the housing body and the operating portion are connected together is cut off when the operating portion is pressed.

7. The connector according to claim 4, wherein the housing body includes an opening portion into which the connecting member is inserted, a side of the opening portion of the housing body includes a contact insertion slot into which each of the contacts is inserted, and the operating portion is provided in an opposite side to the contact insertion slot of the housing body.

8. The connector according to claim 4, wherein the contacts each include: an operating piece to be pressed by a pressing portion formed in the operating portion in a side arranged in an opposite side to the contact insertion slot; and an arm portion having a contact portion to be brought into contact with the connecting member, in an opposite side to the operating piece, and when the operating portion is operated, the operating piece is pressed by the pressing portion moved, and the arm portion sandwiches the connecting member.

9. The connector according to claim 4, wherein the contacts include a first contact and a second contact that respectively have different shapes from each other, the first contact has a first mounting portion to be mounted to a mounting member, the first mounting portion being formed in the side of the opening portion of the housing body, the second contact has a second mounting portion to be mounted to the mounting member, the second mounting portion being formed in an opposite side to the opening portion of the housing body, and in a side of the mounting member of the housing body, an insertion groove through which the second mounting portion of the second contact is inserted is formed apiece along an insertion direction of the second contact.

10. The connector according to claim 5, wherein the housing body includes an opening portion into which the connecting member is inserted, a side of the opening portion of the housing body includes a contact insertion slot into which each of the contacts is inserted, and the operating portion is provided in an opposite side to the contact insertion slot of the housing body.

11. The connector according to claim 5, wherein the contacts each include: an operating piece to be pressed by a pressing portion formed in the operating portion in a side arranged in an opposite side to the contact insertion slot; and an arm portion having a contact portion to be brought into contact with the connecting member, in an opposite side to the operating piece, and when the operating portion is operated, the operating piece is pressed by the pressing portion moved, and the arm portion sandwiches the connecting member.

12. The connector according to claim 5, wherein the contacts include a first contact and a second contact that respectively have different shapes from each other, the first contact has a first mounting portion to be mounted to a mounting member, the first mounting portion being formed in the side of the opening portion of the housing body, the second contact has a second mounting portion to be mounted to the mounting member, the second mounting portion being formed in an opposite side to the opening portion of the housing body, and in a side of the mounting member of the housing body, an insertion groove through which the second mounting portion of the second contact is inserted is formed apiece along an insertion direction of the second contact.

* * * * *